US010885843B1

(12) United States Patent
Lu et al.

(10) Patent No.: US 10,885,843 B1
(45) Date of Patent: Jan. 5, 2021

(54) TFT PIXEL THRESHOLD VOLTAGE COMPENSATION CIRCUIT WITH A SOURCE FOLLOWER

(71) Applicant: Sharp Kabushiki Kaisha, Osaka (JP)

(72) Inventors: Tong Lu, Oxford (GB); Michael James Brownlow, Oxford (GB); Tim Michael Smeeton, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 16/740,763

(22) Filed: Jan. 13, 2020

(51) Int. Cl.
*G09G 3/325* (2016.01)
*G09G 3/3266* (2016.01)
*G09G 3/3275* (2016.01)

(52) U.S. Cl.
CPC ..... *G09G 3/325* (2013.01); *G09G 3/3266* (2013.01); *G09G 3/3275* (2013.01); *G09G 2300/0426* (2013.01); *G09G 2300/0861* (2013.01); *G09G 2310/0243* (2013.01); *G09G 2310/0267* (2013.01); *G09G 2330/021* (2013.01)

(58) Field of Classification Search
CPC .... G09G 3/325; G09G 3/3275; G09G 3/3266; G09G 2330/021; G09G 2310/0267; G09G 2300/0426; G09G 2300/0861; G09G 2310/0243
See application file for complete search history.

(56) References Cited

U.S. PATENT DOCUMENTS

| | | | | |
|---|---|---|---|---|
| 6,323,631 | B1 * | 11/2001 | Juang | G05F 3/205 323/315 |
| 7,414,599 | B2 | 8/2008 | Chung et al. | |
| 8,378,933 | B2 | 2/2013 | Kwak et al. | |
| 9,412,299 | B2 | 8/2016 | Miyazawa et al. | |
| 9,626,905 | B2 | 4/2017 | In et al. | |
| 1,024,262 | A1 | 3/2019 | Tseng et al. | |
| 10,339,858 | B2 * | 7/2019 | Li | G09G 3/325 |
| 10,565,932 | B2 * | 2/2020 | Zhang | G09G 3/3233 |
| 10,672,332 | B2 * | 6/2020 | Lee | G09G 3/3225 |

(Continued)

*Primary Examiner* — Grant Sitta
(74) *Attorney, Agent, or Firm* — Renner, Otto, Boisselle & Sklar, LLP

(57) ABSTRACT

A pixel circuit for a display device operable in an initialization phase, a compensation phase, a data programming phase, and an emission phase, whereby the one horizontal time is minimized while maintaining accurate compensation of the threshold voltages of the drive transistors, and further accounting for any variations in the voltage supplies. The pixel circuit includes a first drive transistor configured to control an amount of current to a light-emitting device during an emission phase depending upon voltages applied to a gate and a first terminal of the first drive transistor; and a second drive transistor that is configured as a source follower, wherein a first terminal of the second drive transistor is connected to a first power supply line and a second terminal of the second drive transistor is connected to a first terminal of the first drive transistor. The first drive transistor is one of a p-type or n-type transistor and the second drive transistor is the other of a p-type or n-type transistor. A light-emitting device is electrically connected at a first terminal to a second terminal of the first drive transistor during the emission phase and at a second terminal to a second power supply line.

17 Claims, 20 Drawing Sheets

(56) References Cited

U.S. PATENT DOCUMENTS

2006/0103322 A1* 5/2006 Chung ..... G09G 3/3233 315/169.3
2012/0139957 A1* 6/2012 Choi ..... G09G 3/3233 345/690
2014/0084805 A1* 3/2014 Kim ..... G09G 3/2048 315/228
2014/0152719 A1* 6/2014 Jung ..... G09G 3/3233 345/691
2015/0002377 A1* 1/2015 Liu ..... G09G 3/3233 345/77
2015/0062193 A1* 3/2015 Kanda ..... G09G 3/3233 345/690
2015/0221251 A1* 8/2015 Wang ..... G09G 3/3208 345/690
2015/0379956 A1* 12/2015 Nonaka ..... G09G 3/325 315/172
2016/0019836 A1* 1/2016 Qing ..... G09G 3/3233 345/76
2016/0086545 A1* 3/2016 Matsueda ..... G09G 3/2096 345/212
2016/0104427 A1* 4/2016 Matsueda ..... G09G 3/3233 345/212
2016/0225318 A1* 8/2016 Choi ..... G09G 3/3258
2016/0253958 A1* 9/2016 Ma ..... G09G 3/3225 345/211
2017/0200414 A1* 7/2017 Li ..... G09G 3/3233
2017/0249903 A1* 8/2017 Xiang ..... G09G 3/3266
2018/0033365 A1* 2/2018 Zhang ..... G09G 3/3291
2018/0286314 A1* 10/2018 Cho ..... H01L 51/5203
2018/0350307 A1* 12/2018 Tsai ..... H01L 51/5012
2019/0103055 A1* 4/2019 Gao ..... G09G 3/3233
2019/0131371 A1* 5/2019 Yi ..... H01L 27/1255
2019/0172888 A1* 6/2019 Choi ..... H01L 51/5234
2019/0180688 A1* 6/2019 Yang ..... H01L 27/3265
2019/0189055 A1* 6/2019 Zhang ..... H01L 27/12
2019/0295467 A1* 9/2019 Lu ..... G09G 3/3233
2019/0295473 A1* 9/2019 Lu ..... G09G 3/3266
2020/0135114 A1* 4/2020 Lee ..... G09G 3/3233
2020/0211467 A1* 7/2020 Kang ..... G09G 3/3291
2020/0234639 A1* 7/2020 Yang ..... G09G 3/3233

* cited by examiner

TFT PIXEL THRESHOLD VOLTAGE COMPENSATION CIRCUIT WITH A SOURCE FOLLOWER

TECHNICAL FIELD

The present invention relates to design and operation of electronic circuits for delivering electrical current to an element in a display device, such as for example to an organic light-emitting diode (OLED) in the pixel of an active matrix OLED (AMOLED) display device.

BACKGROUND ART

Organic light-emitting diodes (OLED) generate light by re-combination of electrons and holes, and emit light when a bias is applied between the anode and cathode such that an electrical current passes between them. The brightness of the light is related to the amount of the current. If there is no current, there will be no light emission, so OLED technology is a type of technology capable of absolute blacks and achieving almost "infinite" contrast ratio between pixels when used in display applications.

Several approaches are taught in the prior art for pixel thin film transistor (TFT) circuits to deliver current to an element of a display device, such as for example an organic light-emitting diode (OLED), through a p-type drive transistor. In one example, an input signal, such as a low "SCAN" signal, is employed to switch transistors in the circuit to permit a data voltage, VDAT, to be stored at a storage capacitor during a programming phase. When the SCAN signal is high and the switch transistors isolate the circuit from the data voltage, the VDAT voltage is retained by the capacitor, and this voltage is applied to a gate of a drive transistor. With the drive transistor having a threshold voltage $V_{TH}$, the amount of current to the OLED is related to the voltage on the gate of the drive transistor by:

$$I_{OLED} = \frac{\beta}{2}(V_{DAT} - V_{DD} - V_{TH})^2$$

where $V_{DD}$ is a power supply connected to the source of the drive transistor.

TFT device characteristics, especially the TFT threshold voltage $V_{TH}$, may vary with time or among comparable devices, for example due to manufacturing processes or stress and aging of the TFT device over the course of operation. With the same VDAT voltage, therefore, the amount of current delivered by the drive TFT could vary by a significant amount due to such threshold voltage variations. Therefore, pixels in a display may not exhibit uniform brightness for a given VDAT value.

Conventionally, therefore, OLED pixel circuits have high tolerance ranges to variations in threshold voltage and/or carrier mobility of the drive transistor by employing circuits that compensate for mismatch in the properties of the drive transistors. For example, an approach is described in U.S. Pat. No. 7,414,599 (Chung et al., issued Aug. 19, 2008), which describes a circuit in which the drive TFT is configured to be a diode-connected device during a programming period, and a data voltage is applied to the source of the drive transistor.

The threshold compensation time is decided by the drive transistor's characteristics, which may require a long compensation time for high compensation accuracy. For the data programming time, the RC constant time required for charging the programming capacitor is determinative of the programming time. As is denoted in the art, the one horizontal (1H) time is the time that it takes for the data to be programmed for one row.

With such circuit configuration as in U.S. Pat. No. 7,414,599, the data is programmed at the same time as when the threshold voltage of the drive transistor is compensated. It is desirable, however, to have as short of a one horizontal time as possible to enhance the responsiveness and operation of the display device. This is because each row must be programmed independently, whereas other operations, such as for example drive transistor compensation, may be performed for multiple rows simultaneously. The responsiveness of the display device, therefore, tends to be dictated most by the one horizontal time for programming. When the data is programmed during the same operational phase that the drive transistor is compensated, the one horizontal time cannot be reduced further due to compensation accuracy requirements for the drive transistor, as the compensation requirements limit any time reductions for the programming phase.

Another drawback of circuits configured comparably as described in U.S. Pat. No. 7,414,599 is that the voltage variation at power supply line, such as the IR drop at power supply ELVDD line, will affect the OLED current. At the end of the data programming and threshold compensation phase, the stored voltage across the capacitor is:

$$V_{DD_{PROG}} - (V_{DAT} - |V_{TH}|)$$

where $V_{DD_{PROG}}$ is the ELVDD voltage at the end of the programming and compensation phase, which is applied to a first plate of the storage capacitor. $V_{DAT} - |V_{TH}|$ is the programmed and compensated voltage at a second plate of the storage capacitor.

The IR drop for each pixel on the same SCAN row can be different depending on the programming data voltage. Similarly, the IR drop for pixels on different rows are different depending on the emission data. The IR drop difference means that the ELVDD supply voltage $V_{DD_{PROG}}$ during programming will be different for each pixel. This difference can cause differences in OLED current even when the programmed data voltages are the same and the threshold voltage has been compensated perfectly. The uniformness of the display will be degraded by the VDD voltage supply variations resulting from differences in the IR drop.

Another approach is described in U.S. Pat. No. 8,378,933 (Won-Kyu Kwak, issued Feb. 19, 2013). The IR drop is compensated by adding a second capacitor between the gate and source of the drive transistor. Any supply voltage variations between the programming/compensation phase and the emission phase will be transferred to the drive transistor gate by the second capacitor. The supply voltage variation thus can be compensated, but this approach uses one more capacitor for IR drop only, and the threshold compensation and data programming phases are performed at the same time. Hence, the one horizontal time cannot be reduced.

Another approach is described in U.S. Pat. No. 9,626,905 (Hai-Jung In, issued Apr. 18, 2017). The threshold voltage of the drive transistor is firstly compensated and stored to one capacitor. Then the data voltage is programmed and stored in another capacitor. The gate voltage of the drive transistor is the sum of the data voltage and the threshold voltage. In this way, the threshold voltage compensation and the data programming are separated. The one horizontal time therefore can be reduced for fast programming, but during the threshold compensation, the stored voltage still depends on the power supply ELVDD. Any IR drop variations on the ELVDD supply line still affect the OLED current, and hence the uniformness of the display is degraded.

Another approach is described in U.S. Ser. No. 10/242,622 (Chang-Ho Tseng, issued Mar. 26, 2019). In such circuit, a reference voltage is applied to the source of the diode-connected drive transistor; a data voltage is applied to a first plate of a storage capacitor; and a second plate of the storage capacitor is connected to the gate of the diode-connected drive transistor. In this way, during the compensation and data programming phase, the voltage stored across the drive transistor is not related to the supply voltage ELVDD. While there is almost no current flow through the reference voltage, there are no IR drop adverse effects either from the supply voltage ELVDD or the reference voltage, but this scheme uses several additional transistors so the circuit configuration is not suitable for high resolution display applications. In addition, the threshold compensation and data programming are performed at the same time, and hence the one horizontal time also cannot be reduced.

Another approach is described in U.S. Pat. No. 9,412,299 (Toshio Miyazawa, issued Aug. 9, 2016). In such configuration, an n-type drive transistor is used. The threshold voltage of the drive transistor is first compensated and stored on a first capacitor. Then the data voltage is applied to one plate of the first capacitor. As the threshold compensation and data programming phases are separated, the one horizontal time can be reduced. When the data voltage is applied to the first capacitor, the supply voltage ELVDD is removed, and thus any supply voltage variations via the IR drop will not affect the OLED current. At the emission phase, the data voltage is scaled between two capacitors, but the gate-source voltage of the drive transistor will depend on the OLED voltage, which could vary from pixel to pixel and could change due to aging and thus this configuration also is deficient.

SUMMARY OF INVENTION

There is a need in art, therefore, for an enhanced pixel circuit that (1) provides for separate compensation and data programming phases to permit minimization of the one horizontal (1H) time, and (2) accounts for variations in the voltage supply VDD to enhance the uniformity of the display device output. The present invention relates to pixel circuits that are capable of compensating the threshold voltage variations of the drive transistor with an ultra-short one horizontal time 1H of less than about 2 μs, which is shorter as compared to conventional configurations. In addition, the pixel circuit configurations described in the current application isolate the power supplies from the drive transistor. Any power supply variations, therefore, such as caused by an IR drop from the power supply to the drive transistor, will not affect the current to the OLED. An image having a generally uniform luminance thus can be displayed regardless of the voltage drop variations of the power supplies.

Embodiments of the present application provide pixel circuits for high refresh rate requirements, such as for 120 Hz applications. For such applications, an ultra-short 1H time (<2 μs) is achieved via separation of threshold compensation of the drive transistor and data programming phases. The threshold compensation time is dictated by the drive transistor characteristics and is difficult to reduce further without degrading the compensation accuracy. By separating the threshold compensation and data programming phases, a longer time can be allocated to threshold compensation for compensation accuracy. As referenced above, the RC constant time required for charging the programming capacitor is determinative of the programming time, and such programming time can be reduced to ultra-short 1H times (<2 μs).

Variations in voltage supplies, ELVDD, are accounted for by isolating the drive transistor from such power supply. To isolate the drive transistor from the power supply ELVDD, a second drive transistor configured as source follower is connected between the first drive transistor and the power supply ELVDD. The source voltage of the first drive transistor is driven by the output of the source follower configured from the second drive transistor. The source voltage of the first drive transistor, therefore, is no longer affected by variations in the power supply ELVDD. Hence, any IR drop on the power supply ELVDD line will not cause non-uniform luminance.

In exemplary embodiments, low leakage transistors, such as IGZO (indium gallium zinc oxide) transistors, can be used as the switch transistors connected to respective voltage supply lines. By using low leakage transistors, either a low storage capacitor can be used to reduce the pixel size or a low refresh rate such as 30 Hz or lower can be used to better display static or low motion images. Power consumption thus can be reduced.

An aspect of the invention, therefore, is a pixel circuit for a display device operable in an initialization phase, a compensation phase, a data programming phase, and an emission phase, whereby the one horizontal time is minimized while maintaining accurate compensation of the threshold voltages of the drive transistors, and further accounting for any variations in the voltage supplies. In exemplary embodiments, the pixel circuit includes a first drive transistor configured to control an amount of current to a light-emitting device during an emission phase depending upon voltages applied to a gate and a first terminal of the first drive transistor; a second drive transistor that is configured as a source follower, wherein a first terminal of the second drive transistor is connected to a first power supply line and a second terminal of the second drive transistor is connected to a first terminal of the first drive transistor, and a voltage at the second terminal of the second drive transistor follows a voltage applied to a gate of the second drive transistor; wherein the first drive transistor is one of a p-type or n-type transistor and the second drive transistor is the other of a p-type or n-type transistor; and a light-emitting device that is electrically connected at a first terminal to a second terminal of the first drive transistor during the emission phase and at a second terminal to a second power supply line.

In exemplary embodiments, the pixel circuit further includes a first capacitor and a second capacitor, wherein the first capacitor is connected at a first plate to the gate of the first drive transistor and at a second plate to a first plate of the second capacitor, and the second capacitor is connected at a second plate to the gate of the second drive transistor. The pixel circuit further may include multiple switch transistors that control the application of supply voltages to the first and second drive transistors, to the first and second capacitors, and to the light-emitting device, during the different phases of operation.

Another aspect of the invention is a method of operating a pixel circuit according to any of the embodiments, whereby the one horizontal time is minimized while maintaining accurate compensation of the threshold voltages of the drive transistors, and further accounting for any variations in the voltage supplies. In exemplary embodiments, the method of operating includes the steps of providing a pixel circuit according to any of the embodiments; performing a compensation phase to compensate threshold voltages of the first and second drive transistors comprising: diode connecting the first drive transistor by placing a first switch transistor in an on state to electrically connect the gate and the second terminal of the first drive transistor through the first switch transistor; applying a reference voltage from the reference voltage line to the gate of the second drive transistor through a third switch transistor; and electrically disconnecting the first terminal of the light emitting device from the second terminal of the first drive transistor; wherein the threshold voltages of the first and second drive transistors are stored on the first plate of the first capacitor; performing a data programming phase to program a data voltage from the data voltage line to the second capacitor, comprising applying the data voltage through a second switch transistor to the second plate of the second capacitor and to the gate of the second drive transistor; and performing an emission phase during which light is emitted from the light-emitting device comprising: applying the first power supply to the first terminal of the second drive transistor; and electrically connecting the second terminal of the first drive transistor to the first plate of the light-emitting device thereby applying the second power supply to the second terminal of the light-emitting device. The method of operating further may include performing an initialization phase to initialize the gate voltage of the first drive transistor, the gate voltage of the second drive transistor, the voltage across the light-emitting device, and the voltage across the first storage capacitor and the second storage capacitor.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF EMBODIMENTS

Figure 1:
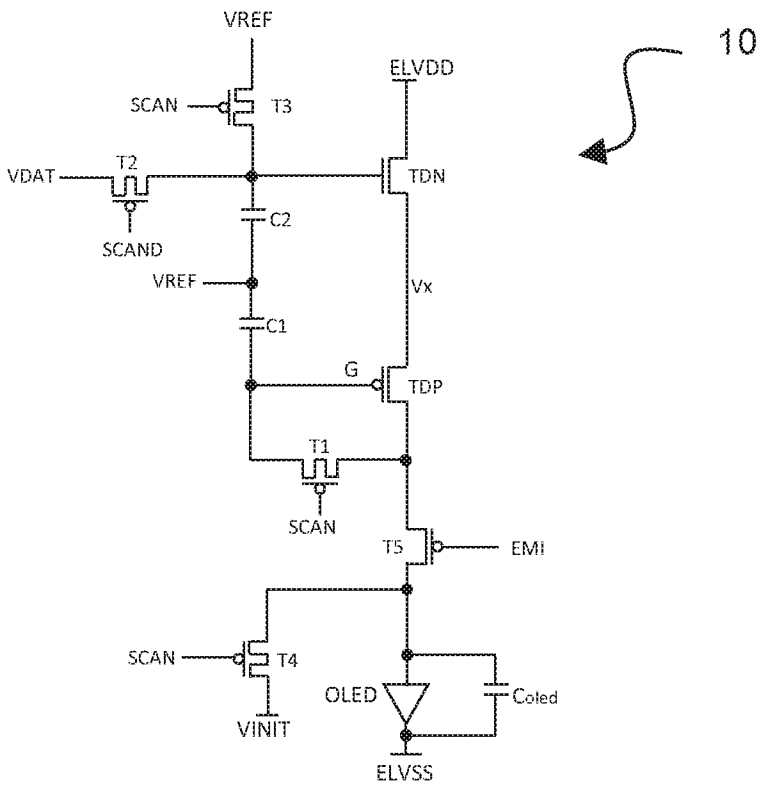
FIG. 1 is a drawing depicting a first circuit configuration in accordance with embodiments of the present application.

Embodiments of the present invention will now be described with reference to the drawings, wherein like reference numerals are used to refer to like elements throughout. It will be understood that the figures are not necessarily to scale.

Figure 2:
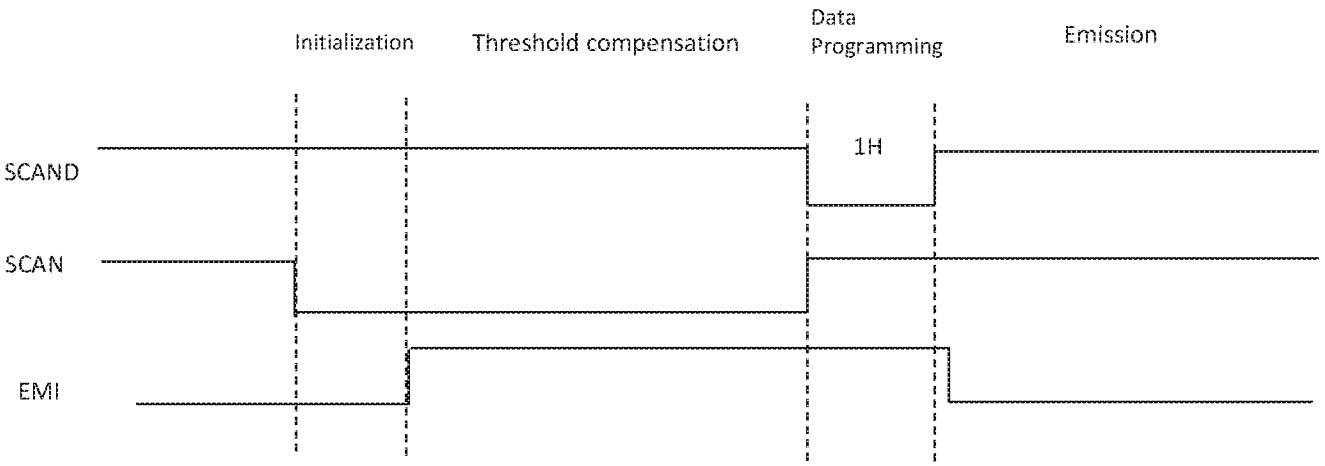
FIG. 2 is a drawing depicting a timing diagram associated with the operation of the circuit of FIG. 1.

FIG. 1 is a drawing depicting a first circuit configuration 10 in accordance with embodiments of the present application, and FIG. 2 is a timing diagram associated with the operation of the circuit configuration 10 of FIG. 1. In this example, the circuit 10 is configured as a thin film transistor (TFT) circuit that includes multiple p-type transistors TDP, T1, T2, T3, T4, T5, a n-type transistor $T_{DN}$ and two capacitors C1 and C2. In this exemplary embodiment, T1, T2, T3 and T4 are double-gate TFTs as desirable for certain applications, which have low leakage between the source and drain, although T1-T4 each alternatively may be a single gate TFT. The circuit elements drive a light-emitting device, such as for example an OLED. The light-emitting device (OLED) has an associated internal capacitance, which is represented in the circuit diagram as Cole. In addition, although the embodiments are described principally in connection with an OLED as the light-emitting device, comparable principles may be used with display technologies that employ other types of light-emitting devices, including for example micro LEDs and quantum dot LEDs.

More specifically, FIG. 1 depicts the TFT circuit 10 configured with multiple p-type TFTs and one n-type TFT. $T_{DP}$ is a p-type drive transistor that is an analogue TFT, T2-T5 are p-type digital switch TFTs, and $T_{DN}$ is an n-type drive transistor that is an analogue TFT. As referenced above, C1 and C2 are capacitors and they are both storage capacitors. $C_{oled}$ is the internal capacitance of the OLED device (i.e., $C_{oled}$ is not a separate component, but is inherent to the OLED). The OLED further is connected to a power supply ELVSS as is conventional.

The OLED and the TFT circuit 10, including the transistors, capacitors and connecting wires, may be fabricated using TFT fabrication processes conventional in the art. It will be appreciated that comparable fabrication processes may be employed to fabricate the TFT circuits according to any of the embodiments.

For example, the TFT circuit 10 (and subsequent embodiments) may be disposed on a substrate such as a glass, plastic, or metal substrate. Each TFT may comprise a gate electrode, a gate insulating layer, a semiconducting layer, a first electrode, and a second electrode. The semiconducting layer is disposed on the substrate. The gate insulating layer is disposed on the semiconducting layer, and the gate electrode may be disposed on the insulating layer. The first electrode and second electrode may be disposed on the insulating layer and connected to the semiconducting layer using vias. The first electrode and second electrode respectively may commonly be referred to as the "source electrode" and "drain electrode" of the TFT. The capacitors each may comprise a first electrode, an insulating layer and a second electrode, whereby the insulating layer forms an insulating barrier between the first and second electrodes. Wiring between components in the circuit, and wiring used to introduce signals to the circuit (e.g. SCAN, EMI, VDAT, VINIT and VREF) may comprise metal lines or a doped semiconductor material. For example, metal lines may be disposed between the substrate and the gate electrode of a TFT, and connected to electrodes using vias. The semiconductor layer may be deposited by chemical vapour deposition, and metal layers may be deposited by a thermal evaporation technique.

The OLED device may be disposed over the TFT circuit. The OLED device may comprise a first terminal (e.g. anode of the OLED), which is connected to transistors T4 and T5 in this example, one or more layers for injecting or transporting charge (e.g. holes) to an emission layer, an emission layer, one or more layers for injecting or transporting electrical charge (e.g. electrons) to the emission layer, and a second terminal (e.g. cathode of the OLED), which is connected to power supply ELVSS in this example. The injection layers, transport layers and emission layer may be organic materials, the first and second electrodes may be metals, and all of these layers may be deposited by a thermal evaporation technique.

Referring to the TFT circuit 10 of FIG. 1 in combination with the timing diagram of FIG. 2, the TFT circuit 10 operates to perform in four phases: an initialization phase, a threshold compensation phase, a data programming phase, and an emission phase for light emission. The time period for performing the programming phase is referred to in the art as the "one horizontal time" or "1H" time as illustrated in the timing diagram and in subsequent the timing diagrams. A short 1H time is a requirement for displays with a large number of pixels in a column, as is necessary for high-resolution displays and for high refresh rates such as used for 120 Hz applications. As referenced above, a short one horizontal time is significant because each row must be programmed independently, whereas other operations, such as for example drive transistor threshold compensation, may be performed for multiple rows simultaneously. The responsiveness of the device, therefore, tends to be dictated most by the one horizontal time for programming.

As described in more detail below, variations in voltage supply, ELVDD, are accounted for by isolating the first drive transistor $T_{DP}$ from such power supply. To isolate the first drive transistor from the power supply ELVDD, the second drive transistor $T_{DN}$ is configured as a source follower, where the output of the source follower follows the gate voltage of the second drive transistor. The gate of the second drive transistor is connected to a reference voltage, where there is little current flow through the reference voltage line hence there is no IR drop issue for the reference voltage. The source voltage of the first drive transistor is driven by the output of the source follower configured by the second drive transistor. Hence, any IR drop on the power supply ELVDD line will not affect the current to the OLED, which avoids the non-uniform luminance that can be experienced in conventional configurations.

The source voltage of the first drive transistor, therefore, is no longer affected by variations in the power supply ELVDD. In addition, during compensation the threshold voltages of the first and the second drive transistors are stored at capacitor C1, and the data voltage VDAT is applied to the second drive transistor for data programming.

In this first embodiment, during the previous emission phase, the EMI signal level has a low voltage value, so transistor T5 is on, and light emission is being driven by the input driving voltage ELVDD connected to the n-type second drive transistor $T_{DN}$, whereby the actual current applied to the OLED is determined by the voltages at the gate and the first terminal of the p-type first drive transistor $T_{DP}$. The SCAN signal levels for the applicable rows initially have a high voltage value so transistors T1, T3, and T4 are all in an off state. The SCAND signal levels for the applicable rows initially have a high voltage value so transistor T2 also is in an off state.

Next, at the beginning of the initialization phase, the SCAN signal level is changed from a high voltage value to a low voltage value, causing transistors T1, T3 and T4 to be turned on. As transistor T1 is turned on, gate and drain of the p-type first drive transistor $T_{DP}$ are electrically connected together through transistor T1, and the drive transistor $T_{DP}$ becomes diode-connected. Diode-connected refers to the drive transistor $T_{DP}$ being operated with its gate and a second terminal (e.g., source or drain) being electrically connected, such that current flows in one direction. As transistor T3 is turned on, a reference voltage, VREF, is applied from a reference voltage input line to the gate of the n-type second drive transistor $T_{DN}$. The reference voltage VREF is set to satisfy the following equation:

$$V_{REF} > V_{INIT} + |V_{THp}| + V_{THn}$$

where $V_{THp}$ is the threshold voltage of the p-type first drive transistor and $V_{THn}$ is the threshold voltage of the n-type second drive transistor. As transistor T4 is turned on, an initialization voltage, VINIT, is applied from an initialization voltage input line to the anode of the OLED. The VINIT voltage is set to lower than the threshold voltage of the OLED plus ELVSS, and thus the VINIT voltage does not cause light emission when applied at anode of the OLED. As T5 is turned on, the initialization voltage VINIT is also applied to the diode-connected gate and drain of the p-type drive transistor and a node G, where the bottom plate of the first storage capacitor C1 and the gate of the p-type drive transistor $T_{DP}$ are connected. A voltage at a node Vx, where the source of the p-type drive transistor $T_{DP}$ and the source of the n-type drive transistor $T_{DN}$ are connected, is also pulled down by VINIT. At the end of initialization phase, the voltage level of node Vx will be:

$$V_{INIT} + |V_{THp}| < V_x \leq V_{REF} - V_{THn}$$

The TFT circuit 10 next is operable in a threshold compensation phase, during which the threshold voltages of the p-type first drive transistor $T_{DP}$ and n-type second drive transistor $T_{DN}$ are compensated. For such phase, the EMI signal level is changed from a low voltage value to a high voltage value, causing transistor T5 to be turned off, and the diode-connected gate and drain of the p-type drive transistor become floating. The voltage at node Vx becomes floating as well.

During the threshold compensation, the Vx voltage will be pulled up towards $V_{REF}-V_{THn}$ as the n-type second drive transistor $T_{DN}$ is turning off. The voltage at node G, where the gate of the diode-connected p-type first drive transistor and the bottom plate of the first storage capacitor C1 are connected, will be pulled up towards $V_x-|V_{THp}|$ as the p-type drive transistor $T_{DP}$ also is turning off.

At the end of the threshold compensation phase, the SCAN signal level is changed from a high voltage value to a low voltage value, causing transistors T1, T3 and T4 to be turned off. As transistor T1 is turned off, the gate and the drain of the p-type first drive transistor $T_{DP}$ are disconnected and the p-type drive transistor $T_{DP}$ is no longer diode-connected. The voltage at node G is $V_{REF}-V_{THn}-|V_{THp}|$. The threshold voltages of the n-type second drive transistor $T_{DN}$ and the p-type first drive transistor $T_{DP}$ are stored at the bottom plate of the storage capacitor C1 with the top plate of C1 being connected to the reference voltage line VREF. With transistor T3 turned off, the gate of the n-type second drive transistor $T_{DN}$ is disconnected from the reference voltage line, VREF. With transistor T4 turned off, the anode of the OLED is disconnected from the initialization voltage line, VINIT.

The TFT circuit 10 next is operable in a data programming phase. The SCAND signal level is changed from the high voltage value to the low voltage value, causing transistor T2 to be turned on, which electrically connects the data voltage input line VDAT to the top plate of the second storage capacitor C2 and to the gate of the n-type second drive transistor $T_{DN}$. The data voltage, VDAT, is changed from the value for another pixel (e.g. the previous row of the display DATA(n−1)) to the data value for the current pixel (e.g. the current row of the display DATA(n)), which is applied from the data voltage input line to the top plate of the second storage capacitor C2 with the bottom plate of C2 being connected to the reference voltage line, VREF.

At the end of the data programming phase, the SCAND signal level is changed from the low voltage value to the high voltage value, causing transistor T2 to be turned off. The gate of the n-type second drive transistor $T_{DN}$ and the top plate of the second capacitor C2 are disconnected from the data voltage line, VDAT. VDAT will be changed to a corresponding value for the next row data programming.

The TFT circuit 10 next is operable in an emission phase during which the OLED is capable of emitting light. The EMI signal is changed from the high voltage value to the low voltage value, causing transistor T5 to be turned on. As transistor T5 is turned on, the drain of the p-type first drive transistor $T_{DP}$ is connected to the anode of the OLED. The same current flows through the n-type second drive transistor $T_{DN}$, p-type first drive transistor $T_{DP}$, and the OLED. Such current that flows through the n-type second drive transistor is:

$$I_{dn} = \frac{\beta_{TDN}}{2}(V_{DAT} - V_x - V_{TH_n})^2$$

where $$\beta_{TDN} = \mu_{nn} \cdot C_{oxn} \cdot \frac{W_n}{L_n},$$

$C_{oxn}$ is the capacitance of the n-type drive transistor gate oxide;

$W_n$ is the width of the n-type drive transistor channel;

$L_n$ is the length of the n-type drive transistor channel (i.e. distance between source and drain);

$\mu_n$ is the carrier mobility of the n-type drive transistor.

The current flows through the p-type first drive transistor is:

$$I_{dp} = \frac{\beta_{TDP}}{2}(V_x - V_G - |V_{TH_{Tp}}|)^2$$

where $$\beta_{TDP} = \mu_{np} \cdot C_{oxp} \cdot \frac{W_p}{L_p},$$

$C_{oxp}$ is the capacitance of the p-type drive transistor gate oxide;

W is the width of the p-type drive transistor channel;

$L_p$ is the length of the p-type drive transistor channel (i.e. distance between source and drain);

$V_G$ is the voltage at node G; and $\mu_{np}$ is the carrier mobility of the p-type drive transistor.

As referenced above, such currents are equal, and thus equating the two above expressions, as $I_{dn}=I_{dp}$, yields:

$$\frac{\beta_{TDN}}{2}(V_{DAT} - V_x - V_{TH_n})^2 = \frac{\beta_{TDP}}{2}(V_x - V_G - |V_{TH_p}|)^2 \Rightarrow \sqrt{\beta_{TDN}}\,(V_{DAT} - V_x - V_{TH_n}) = \sqrt{\beta_{TDP}}\,(V_x - V_G - |V_{TH_p}|)$$

$$\text{As } V_G = V_{REF} - V_{THn} - |V_{THp}| \Rightarrow \sqrt{\beta_{TDN}}\,(V_{DAT} - V_x - V_{TH_n}) = \sqrt{\beta_{TDP}}\,(V_x - V_{REF} + V_{TH_n}) \Rightarrow V_x = \frac{\sqrt{\beta_{TDN}}\,V_{DAT} + \sqrt{\beta_{TDP}}\,V_{REF}}{\sqrt{\beta_{TDN}} + \sqrt{\beta_{TDP}}} - V_{THn} \Rightarrow I_{dn} = \frac{\beta_{TDN}}{2}\left(V_{DAT} - \left(\frac{\sqrt{\beta_{TDN}}\,V_{DAT} + \sqrt{\beta_{TDP}}\,V_{REF}}{\sqrt{\beta_{TDN}} + \sqrt{\beta_{TDP}}} - V_{THn}\right) - V_{THn}\right)^2 = \frac{\beta_{TDN}\beta_{TDP}(V_{REF} - V_{DAT})^2}{2(\sqrt{\beta_{TDN}} + \sqrt{\beta_{TDP}})^2}$$

In addition, as referenced above as $I_{OLED}=I_{dn}=I_{dp}$:

$$I_{OLED} = \frac{\beta_{TDN}\beta_{TDP}(V_{REF} - V_{DAT})^2}{2(\sqrt{\beta_{TDN}} + \sqrt{\beta_{TDP}})^2}$$

Accordingly, the current to the OLED does not depend on the threshold voltage of either of the p-type first drive transistor $T_{DP}$ or the threshold voltage of the n-type second drive transistor $T_{DN}$, and hence the current to the OLED device $I_{OLED}$ is not affected by the threshold voltage variations of the drive transistors. In this manner, variation in the threshold voltages of the drive transistors has been compensated.

In accordance with the above, the n-type second drive transistor $T_{DN}$ isolates power supply ELVDD from the p-type first drive transistor $T_{DP}$. The n-type drive transistor thus functions as a source follower. The source voltage of the n-type drive transistor $T_{DN}$ at node Vx, which is also the source voltage of the p-type drive transistor $T_{DP}$, is only related to the gate voltage of the n-type drive transistor $T_{DN}$. The n-type source follower is designed not to limit the current from the supply ELVDD to the OLED, whereas the p-type drive transistor will control or limit the current to the OLED. The current is related to the gate voltage of the p-type transistor and the Vx voltage. As node Vx is isolated from the power supply ELVDD, the current to the OLED, which is controlled by the p-type drive transistor $T_{DP}$, is not affected by the variations of the supply ELVDD, such as the IR drop on that supply line. The p-type drive transistor further is inherently immune from the drain voltage (the power supply ELVSS) variations, at least not in first order as is relevant to display applications.

In addition, as described above a two-capacitor structure is used, whereby the first capacitor C1 is used for the threshold compensation during the compensation phase, and the second capacitor C2 is used to store the data voltage during the programming phase and the emission phase. The threshold compensation and data programming operations thus are independent of each other, and a short one horizontal time can be achieved with a short data programming phase. The short one horizontal time improves the responsiveness of the OLED.

Figure 3B:
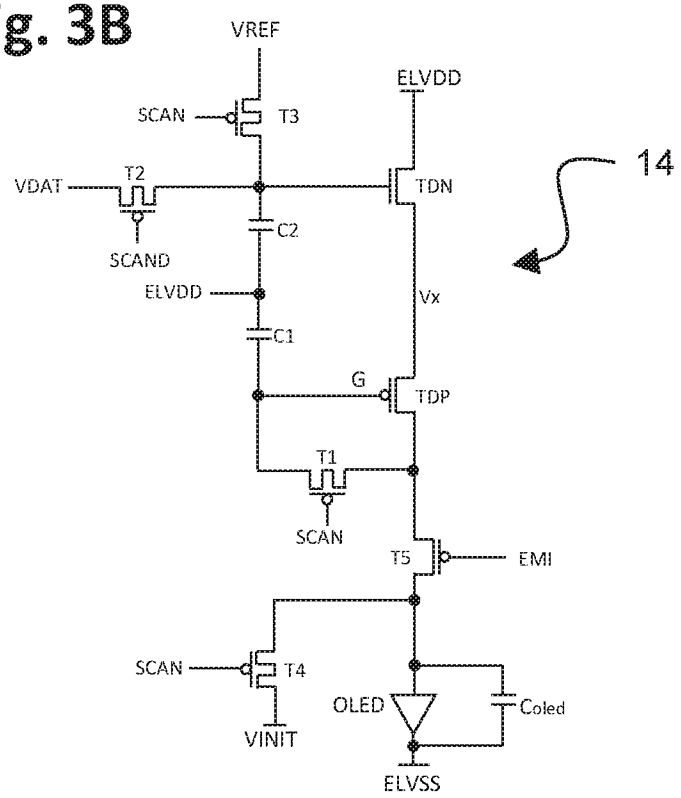
FIG. 3A and FIG. 3B are drawings depicting two circuit variations of the first circuit configuration of FIG. 1.
Figure 3A:
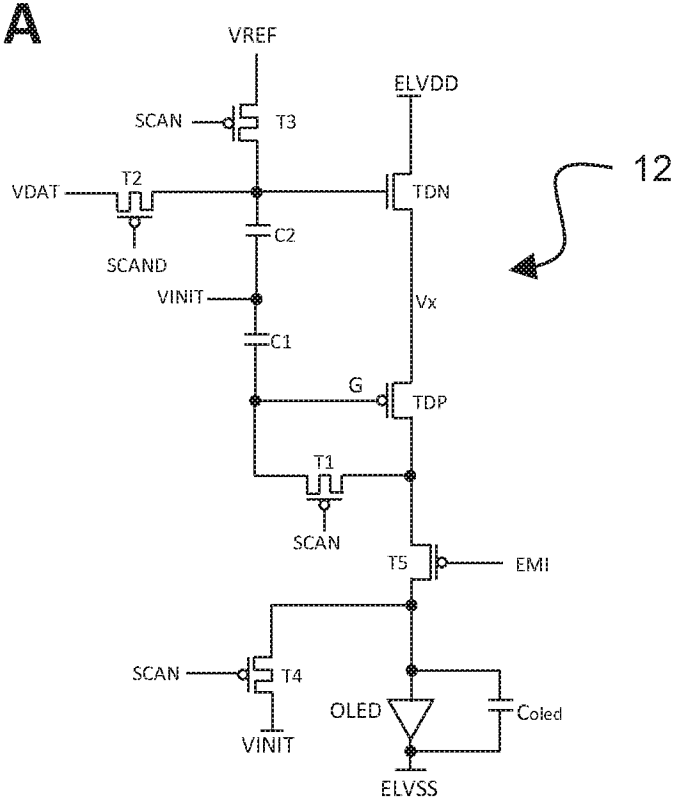

FIG. 3A and FIG. 3B are respective are drawings depicting two circuit configurations 12 and 14 that are variations on the circuit configuration 10 of FIG. 1. The timing diagram of FIG. 2 is equally applicable for the circuit configurations 12 and 14. The difference between circuit configuration 10 and circuit configurations 12 and 14 is the power supply that is connected to the node where the top plate of the first storage capacitor C1 and the bottom plate of the second storage capacitor C2 are connected. In the circuit configuration 10, such node is connected to the reference power supply line, VREF. In the circuit configuration 12 such node is connected to the initialization power supply line VINIT, and in the circuit configuration 14 such node is connected to the power supply ELVDD. In general, the node can be connected to any power supply with a fixed voltage level, which is available for the pixel, to set the voltage at the node between the capacitors relative to the gates of the drive transistors.

Figure 4:
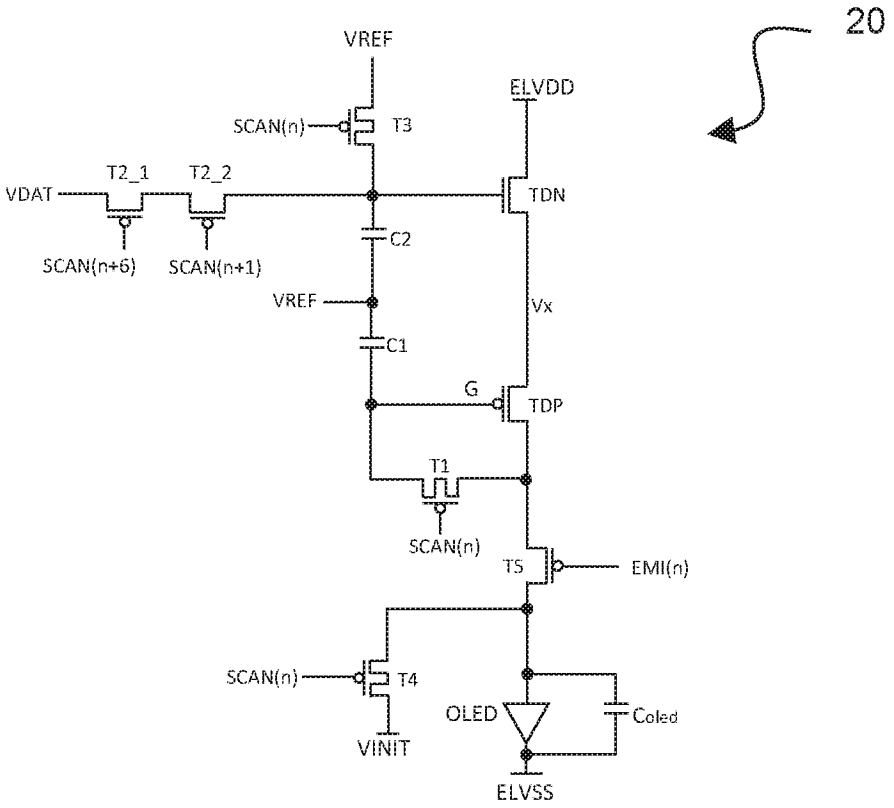
FIG. 4 is a drawing depicting a second circuit configuration in accordance with embodiments of the present application.
Figure 5:
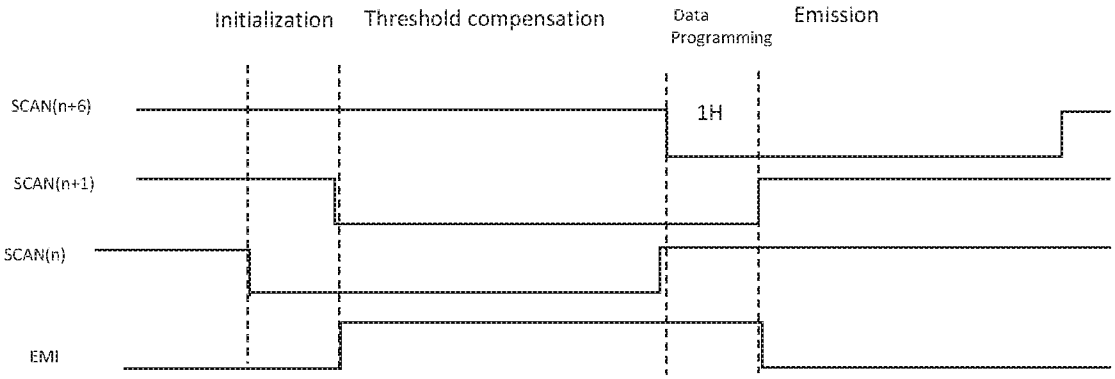
FIG. 5 is a drawing depicting a timing diagram associated with the operation of the circuit of FIG. 4.

FIG. 4 is a drawing depicting a second circuit configuration 20 in accordance with embodiments of the present application, and FIG. 5 is a timing diagram associated with the operation of the circuit configuration 20 of FIG. 4. In this example, similarly as in the previous embodiment, the circuit 20 is configured as a TFT circuit that includes multiple p-type transistors $T_{DP}$, T1, T2_1, T2_2, T3, T4, T5, an n-type transistor $T_{DN}$, and two capacitors C1 and C2. The circuit elements drive a light-emitting device, such as for example an OLED. The light-emitting device (OLED) has an associated internal capacitance, which again is represented in the circuit diagram as $C_{oled}$ (i.e., $C_{oled}$ is not a separate component, but is inherent to the OLED). The OLED further is connected to the power supply ELVSS as is conventional. Similarly as in the previous embodiment, $T_{DP}$ is a p-type drive transistor that is an analogue TFT, $T_{DN}$ is an n-type drive transistor that is an analogue TFT, and T1, T2_1, T2_2, T2_3, T3, T4 and T5 are digital switch TFTs. In addition, although the embodiments are described principally in connection with an OLED as the light-emitting device, comparable principles may be used with display technologies that employ other types of light-emitting devices, including for example micro LEDs and quantum dot LEDs.

Generally, this embodiment has comparable control signals EMI and SCAN for other rows of pixels in the overall or broader display device, thereby enabling fewer control signal wires in a display configuration as common control lines may be shared over different rows. For this example and in subsequent embodiments, display pixels are addressed by row and column. The current row is row n. The previous row is row n−1, and the second previous row is n−2. The next row is row n+1, and the row after that is row n+2, and so on for the various rows as they relate to the corresponding control signals identified in the figures. Accordingly, for example, SCAN(n) refers to the scan signal at row n and SCAN(n+6) refers to the scan signal at row n+6, and the like. EMI(n) refers to the emission signal at row n, and so on for the various control signals. In this manner, for the various embodiments the input signals correspond to the indicated rows.

Referring to the TFT circuit 20 in combination with the timing diagram of FIG. 5, the TFT circuit 20 also operates to perform in four phases: an initialization phase, a compensation phase, a data programming phase, and an emission phase for light emission. The configuration of the components and operation of the circuit 20, therefore, is similar as to the operation of the circuit 10 of FIG. 1, except that the circuit 20 employs SCAN signals from other rows to replace the dedicated SCAND signal in the first embodiment, as further detailed below.

In this second embodiment, during the previous emission phase, the EMI(n) signal level has a low voltage value, so transistor T5 is on, and light emission is being driven by the input driving voltage ELVDD connected to the n-type second drive transistor $T_{DN}$, whereby the actual current applied to the OLED is determined by the voltages at the gate and the first terminal of the p-type first drive transistor $T_{DP}$. The SCAN(n) signal level for the applicable rows initially has a high voltage value so transistors T1, T3, and T4 are all in an off state. The SCAN(n+1) and SCAN(n+6) signal levels for the applicable rows initially have a high voltage value so transistors T2_1 and T2_2 are in an off state.

Next, at the beginning of the initialization phase, the SCAN(n) signal level is changed from a high voltage value to a low voltage value, causing transistors T1, T3, and T4 to be turned on. As transistor T1 is turned on, gate and drain of the p-type first drive transistor $T_{DP}$ are connected together and the drive transistor $T_{DP}$ becomes diode-connected. As transistor T3 is turned on, the reference voltage, VREF, is applied from the reference voltage line to the gate of the n-type second drive transistor $T_{DN}$. The reference voltage VREF is set to satisfy the equation below, whereby VREF will be:

$$V_{REF} > V_{INIT} + |V_{THp}| + V_{THn}$$

where $V_{THp}$ is the threshold voltage of the p-type drive transistor and $V_{THn}$ is the threshold voltage of the n-type drive transistor. As transistor T4 is turned on, the initialization voltage, VINIT, is applied from the initialization voltage line to the anode of the OLED. The VINIT voltage is set to lower than the threshold voltage of the OLED plus ELVSS, and thus the VINIT voltage does not cause light emission when applied at anode of the OLED. As T5 is on, the initialization voltage VINIT is also applied to the diode-connected gate and drain of the p-type first drive transistor and at node G, where the bottom plate of the first storage capacitor C1 and the gate of the p-type first drive transistor are connected. The voltage at the node Vx, where the source of the p-type first drive transistor and the source of the n-type second drive transistor are connected, is also pulled down by VINIT. At the end of initialization phase, the voltage level of Vx will be:

$$V_{INIT}+|V_{THp}|<V_x\leq V_{REF}-V_{THn}$$

At the end of the initialization phase, the SCAN(n+1) signal level is changed from a high voltage value to a low voltage value, causing transistor T2_2 to be turned on and ready for the data programming phase, although the data voltage VDAT is not yet applied as the transistor T2_1 remains in the off state.

The TFT circuit 20 next is operable in a threshold compensation phase, during which the threshold voltages of the p-type first drive transistor $T_{DP}$ and the n-type second drive transistor $T_{DN}$ are compensated. For such phase, the EMI(n) signal level is changed from a low voltage value to a high voltage value, causing transistor T5 to be turned off, and the diode-connected gate and drain of the p-type drive transistor becomes floating. The voltage at node Vx becomes floating as well.

During the threshold compensation, the Vx voltage will be pulled up towards $V_{REF}-V_{TH}$ as the n-type second drive transistor $T_{DN}$ is turning off. The voltage at node G, where the gate of the diode-connected p-type drive first transistor and the bottom plate of the first storage capacitor C1 are connected, will be pulled up towards $V_x-|V_{THp}|$ as the p-type drive second transistor $T_{DP}$ is turning off.

At the end of the threshold compensation phase, the SCAN(n) signal level is changed from a low voltage value to a high voltage value, causing transistors T1, T3, and T4 to be turned off. As transistor T1 is turned off, the gate and the drain of the p-type drive first transistor $T_{DP}$ are disconnected and the p-type drive transistor $T_{DP}$ is no longer diode-connected. The voltage at node G is $V_{REF}-V_{THn}-|V_{THp}|$. The threshold voltages of the n-type drive transistor $T_{DN}$ and the p-type drive transistor $T_{DP}$ are stored on the bottom plate of the first storage capacitor C1 with the top plate of C1 being connected to the reference voltage line VREF. With transistor T3 turned off, the gate of the n-type first drive transistor $T_{DN}$ is disconnected from the reference voltage line, VREF. With transistor T4 is turned off, the anode of the OLED is disconnected from the initialization voltage line, VINIT.

The TFT circuit 20 next is operable in a data programming phase. The SCAN(n+6) signal level is changed from the high voltage value to the low voltage value, causing transistor T2_1 to be turned on. As referenced above, the transistor T2_2 is already turned on at the end of the initialization phase. The data voltage line VDAT thus is electrically connected to the top plate of the second storage capacitor C2 and the gate of the n-type second drive transistor $T_{DN}$. The data voltage, VDAT, is changed from the value for another pixel (e.g. the previous row of the display DATA(n−1)) to the data value for the current pixel (e.g. the current row of the display DATA(n)), which is applied from the data voltage line to the top plate of the second storage capacitor C2 with the bottom plate of C2 being connected to the reference voltage line, VREF.

For the programming phase, SCAN signals applied to different rows (e.g., SCAN(n+1) and SCAN(n+6)) are employed to electrically connect the data voltage line VDAT to the top plate of the second storage capacitor C2. By using SCAN signals from different rows in combination, a short programming pulse results from overlap of the SCAN signals, thereby minimizing the 1H time as shown in the timing diagram of FIG. 5. Although in this embodiment the multiple scan signals SCAN (n+1) and SCAN (n+6) are used to control the switch transistors T2_2 and T2_1 to generate the short programming pulse, the SCAN signals from other rows can be used. This embodiment has an advantage of using existing SCAN signal lines, but requires the two transistors T2_2 and T2_1 to connect VDAT to the storage capacitor C2 during the programming phase. In contrast, the previous embodiment employs an additional dedicated scan line SCAND, but uses only a single transistor T2 to apply the data voltage. The two alternative configurations, therefore, represent a trade-off between an additional scan control line versus an additional transistor as may be suitable for a given application.

At the end of the data programming phase, the SCAN(n+1) signal level is changed from the low voltage value to the high voltage value, causing transistor T2_2 to be turned off. The gate of the n-type second drive transistor $T_{DN}$ and the top plate of the second capacitor C2 are disconnected from the data voltage line, VDAT. VDAT will change to a corresponding value for the next row data programming.

The TFT circuit 20 next is operable in an emission phase during which the OLED is capable of emitting light. The EMI(n) signal is changed from the high voltage value to the low voltage value, causing transistor T5 to be turned on. As transistor T5 is turned on, the drain of the p-type first drive transistor $T_{DP}$ is connected to the anode of the OLED. The same current flows through the n-type drive second transistor $T_{DN}$, p-type first drive transistor $T_{DP}$, and the OLED. The current that flows through the n-type second drive transistor is:

$$I_{dn}=\frac{\beta_{TDN}}{2}(V_{DAT}-V_x-V_{TH_n})^2$$

The current that flows through the p-type first drive transistor is:

$$I_{dp}=\frac{\beta_{TDP}}{2}(V_G-V_x-V_{TH_{Tp}})^2$$

Similarly as in the previous first embodiment, as $I_{dn}=I_{dp}=I_{OLED}$ and $V_G$ $V_{REF}-V_{THn}-|V_{THp}|$, the current flow through the OLED is:

$$I_{OLED}=\frac{\beta_{TDN}\beta_{TDP}(V_{REF}-V_{DAT})^2}{2(\sqrt{\beta_{TDN}}+\sqrt{\beta_{TDP}})^2}$$

Accordingly, the current flow through the OLED does not depend on either the threshold voltage of the p-type drive transistor $T_{DP}$ or the threshold voltage of the n-type drive transistor $T_{DN}$, and hence the current to the OLED device $I_{OLED}$ s not affected by the threshold voltage variations of the drive transistors. In this manner, any variation in the threshold voltages of the drive transistors has been compensated. Similarly in this embodiment, by using a dual drive transistor configuration, the OLED current is not affected by the variations of the supplies ELVDD and ELVSS, such as IR drop on the voltage supply lines. In addition, in this embodiment the threshold compensation and data programming operations also are independent of each other, and a short one horizontal time can be achieved with a short data programming phase. The short one horizontal time improves the responsiveness of the OLED.

Figure 6B:
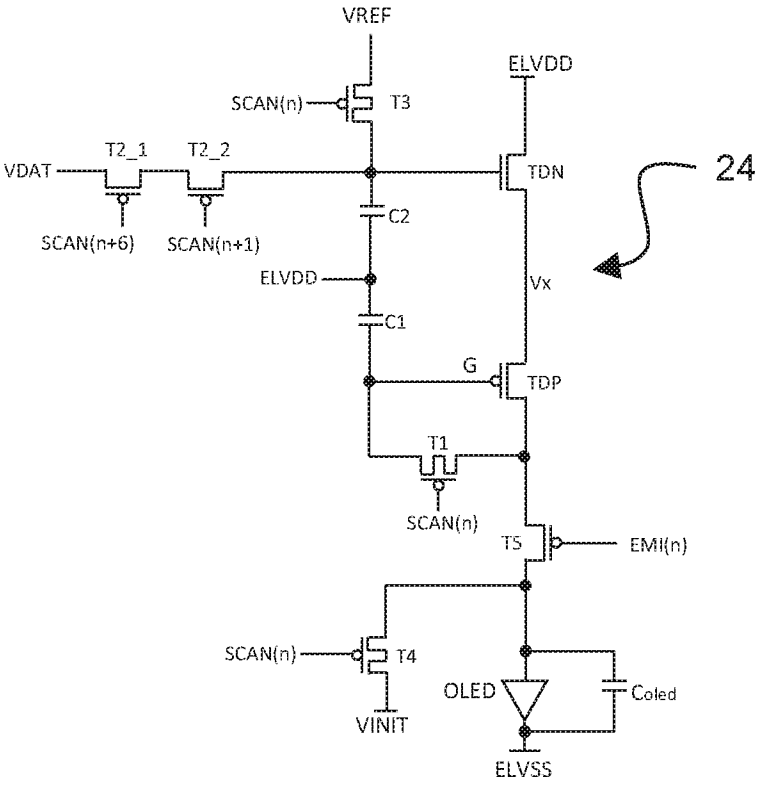
FIG. 6A and FIG. 6B are drawings depicting two circuit variations of the second circuit configuration of FIG. 4.
Figure 6A:
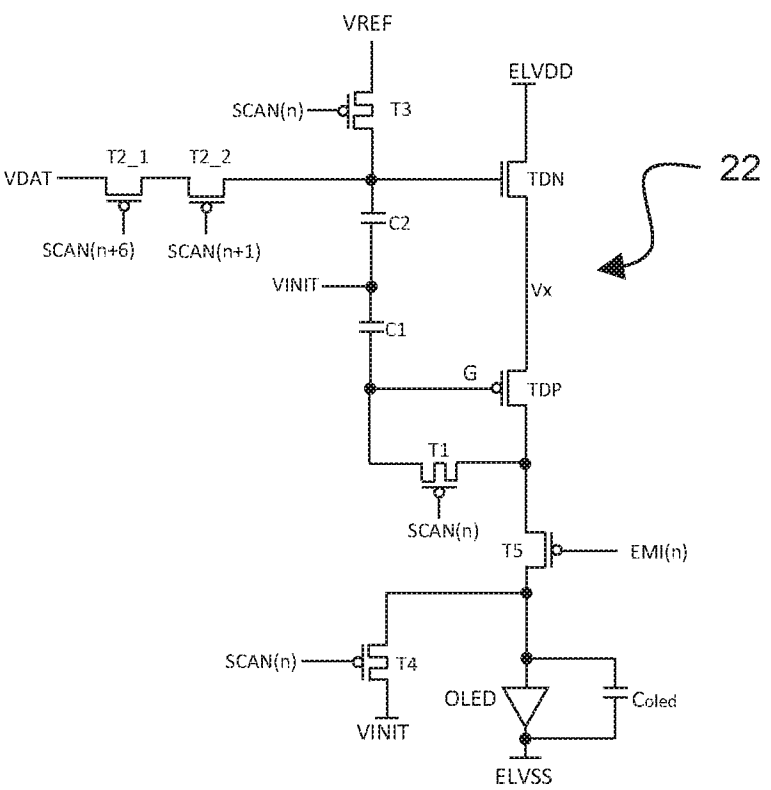

FIG. 6A and FIG. 6B are respective drawings depicting two circuit configurations 22 and 24 that are variations on the circuit configuration 20 of FIG. 4. The timing diagram of FIG. 5 is equally applicable for the circuit configurations 22 and 24. The difference between circuit configuration 20 and circuit configurations 22 and 24 (similarly as in the previous embodiment) is the power supply that is connected to the node where the top plate of the first storage capacitor C1 and the bottom plate of the second storage capacitor C2 are connected. In the circuit configuration 20, such node is connected to the reference power supply line, VREF. In the circuit configuration 22 such node is connected to the initialization power supply line VINIT, and in the circuit configuration 24 such node is connected to the power supply ELVDD. In general, the node can be connected to any power supply with a fixed voltage level, which is available for the pixel, to set the voltage at the node between the capacitors relative to the gates of the drive transistors.

Figure 7:
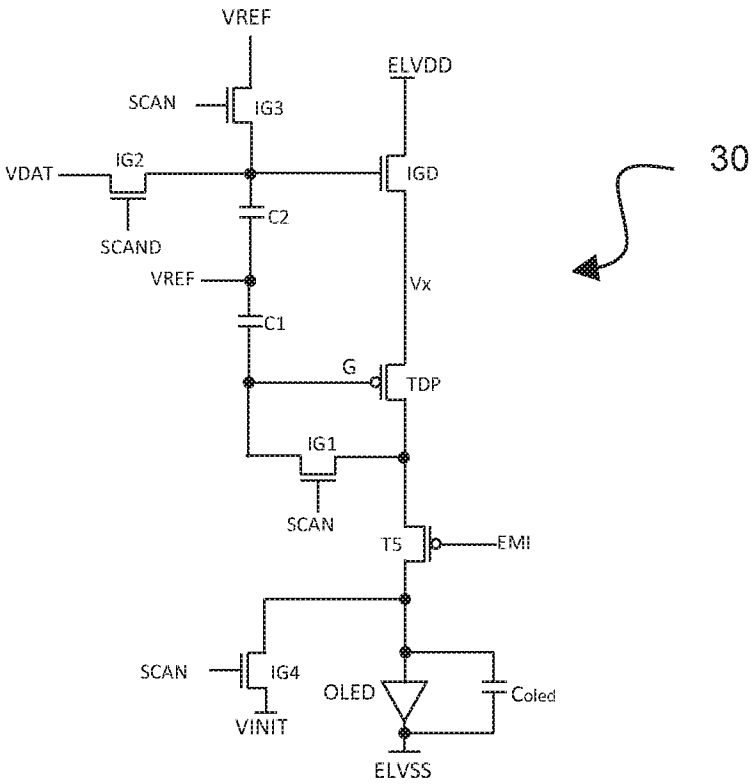
FIG. 7 is a drawing depicting a third circuit configuration in accordance with embodiments of the present application.
Figure 8:
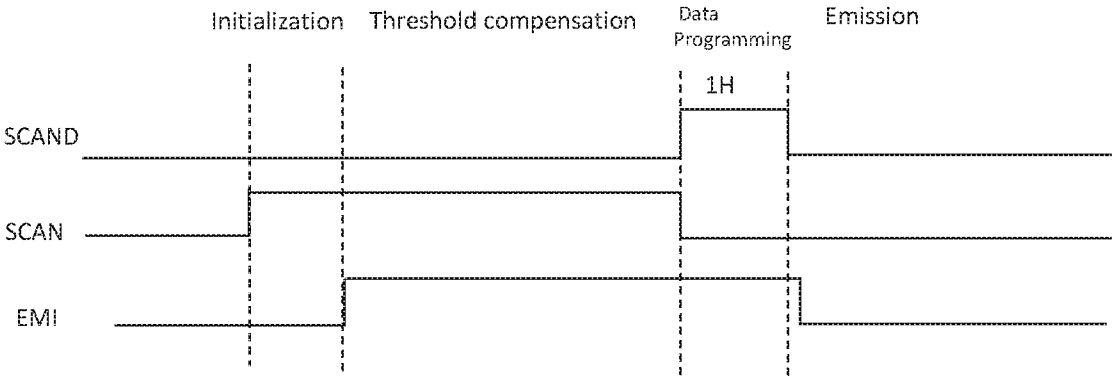
FIG. 8 is a drawing depicting a timing diagram associated with the operation of the circuit of FIG. 7.

FIG. 7 is a drawing depicting a third circuit configuration 30 in accordance with embodiments of the present application, and FIG. 8 is a timing diagram associated with the operation of the circuit configuration 30 of FIG. 7. Embodiments of the present application use an ultra-low leakage oxide transistor, such as indium gallium zinc oxide (IGZO) devices, as the data switch device and the switches associated with the storage capacitors C1 and C2. This permits the stored data voltage and stored drive transistor threshold voltages to be retained longer on the capacitors due to the ultra-low off leakage property of the ultra-low leakage transistors. As a result, the refresh rate can be reduced as compared to conventional configurations, down to about 30 Hz or lower, which is particularly suitable for displaying static images. IGZO transistor devices typically are configured as n-type transistors, as compared to the p-type double gate transistors illustrated with respect to previous embodiments. The use of n-type IGZO switch transistors alters the requisite voltage levels of certain control signals during the operational phases as compared to the previous embodiments, as illustrated in the timing diagram of FIG. 8 and as further detailed below.

More specifically, FIG. 7 depicts the TFT circuit 30 configured with multiple p-type TFTs and n-type IGZO TFTs. $IG_D$ is an IGZO drive transistor that is an analogue TFT; IG1-IG4 are IGZO digital switch TFTs; $T_{DP}$ is a p-type drive transistor that is an analogue TFT and T5 is a p-type digital switch TFT. C1 and C2 are capacitors and they are both storage capacitors. $C_{oled}$ is the internal capacitance of the OLED device (i.e., $C_{oled}$ is not a separate component, but is inherent to the OLED). The OLED further is connected to a power supply ELVSS as is conventional. In addition, although the embodiments are described principally in connection with an OLED as the light-emitting device, comparable principles may be used with display technologies that employ other types of light-emitting devices, including for example micro LEDs and quantum dot LEDs.

In this third embodiment, during the previous emission phase, the EMI signal level has a low voltage value, so transistor T5 is on, and light emission is being driven by the input driving voltage ELVDD connected to the IGZO second drive transistor $IG_D$, whereby the actual current applied to the OLED is determined by the voltages at the gate and the first terminal of the p-type first drive transistor $T_{DP}$. The SCAN signal levels for the applicable rows initially have a low voltage value so transistors IG1, IG3, and IG4 are all in an off state. The SCAND signal level for the applicable rows initially has a low voltage value so transistor IG2 also is in an off state.

Next, at the beginning of the initialization phase, the SCAN signal level is changed from a low voltage value to a high voltage value, causing transistors IG1, IG3, and IG4 to be turned on. As transistor IG1 is turned on, the gate and drain of the p-type first drive transistor $T_{DP}$ are connected together and the drive transistor $T_{DP}$ becomes diode-connected. As transistor IG3 is turned on, the reference voltage, VREF, is applied from the reference voltage line to the gate of the n-type IGZO second drive transistor $IG_D$. The reference voltage VREF is set to satisfy the equation below, such that VREF will be:

$$V_{REF} > V_{INIT} + |V_{THp}| + V_{THn}$$

where $V_{THp}$ is the threshold voltage of the p-type first drive transistor, and $V_{THn}$ is the threshold voltage of the n-type IGZO second drive transistor. As transistor IG4 is turned on, the initialization voltage, VINIT, is applied from the initialization voltage line to the anode of the OLED. The VINIT voltage is set to lower than the threshold voltage of the OLED plus ELVSS, and thus the VINIT voltage does not cause light emission when applied at anode of the OLED. As T5 is on, the initialization voltage VINIT is also applied to the diode-connected gate and drain of the p-type drive transistor and node G, where the bottom plate of the storage capacitor C1 and the gate of the p-type first drive transistor are connected. The voltage at node Vx, where the source of the p-type first drive transistor and the source of the n-type IGZO second drive transistor are connected, is also pulled down by VINIT. At the end of initialization phase, the voltage level of Vx will be:

$$V_{INIT} + |V_{THp}| < V_x \leq V_{REF} - V_{THn}$$

The TFT circuit 30 next is operable in a threshold compensation phase, during which the threshold voltages of the p-type first drive transistor $T_{DP}$ and n-type IGZO second drive transistor $IG_D$ are compensated. For such phase, the EMI signal level is changed from a low voltage value to a high voltage value, causing transistor T5 to be turned off, and the diode-connected gate and drain of the p-type first drive transistor $T_{DP}$ becomes floating. The voltage at node Vx becomes floating as well. During the threshold compensation, the Vx voltage will be pulled up towards $V_{REF}-V_{THn}$ as the n-type IGZO second drive transistor $IG_D$ is turning off. The voltage at node G, where the gate of the diode-connected p-type first drive transistor and the bottom plate of the first storage capacitor C1 are connected, will be pulled up towards $V_x-|V_{THp}|$ as the p-type drive transistor $T_{DP}$ is turning off.

At the end of the threshold compensation phase, the SCAN signal level is changed from the high voltage value to the low voltage value, causing transistors IG1, IG3, and IG4 to be turned off. As transistor IG1 is turned off, the gate and the drain of the p-type first drive transistor $T_{DP}$ are disconnected and the p-type drive transistor $T_{DP}$ is no longer diode-connected. The voltage at node G is $V_{REF}-V_{TH}-|V_{THp}|$. The threshold voltages of the n-type IGZO second drive transistor $IG_D$ and the p-type first drive transistor $T_{DP}$ are stored on the bottom plate of the first storage capacitor C1 with the top plate of C1 being connected to the reference voltage line VREF. With transistor IG3 turned off, the gate of the n-type IGZO second drive transistor $IG_D$ is disconnected from the reference voltage line, VREF. With transistor IG4 turned off, the anode of the OLED is disconnected from the initialization voltage line, VINIT.

The TFT circuit 30 next is operable in a data programming phase. The SCAND signal level is changed from the low voltage value to the high voltage value, causing transistor IG2 to be turned on, which electrically connects the data voltage line VDAT to the top plate the storage capacitor C2 and the gate of the n-type IGZO second drive transistor $T_{DN}$. The data voltage, VDAT, is changed from the value for another pixel (e.g. the previous row of the display DATA (n−1)) to the data value for the current pixel (e.g. the current row of the display DATA(n)), which is applied from the data voltage line to the top plate of storage capacitor C2 with the bottom plate of C2 being connected to the reference voltage line, VREF.

At the end of the data programming phase, the SCAND signal level is changed from the high voltage value to the low voltage value, causing transistor IG2 to be turned off. The gate of the n-type IGZO second drive transistor $IG_D$ and the top plate of the second capacitor C2 are disconnected from the data voltage line, VDAT. VDAT will change to a corresponding value for the next row data programming.

The TFT circuit 30 next is operable in an emission phase during which the OLED is capable of emitting light. The EMI signal is changed from the high voltage value to the low voltage value, causing transistor T5 to be turned on. As transistor T5 is turned on, the drain of the p-type first drive transistor $T_{DP}$ is connected to anode of the OLED. As in previous embodiments, the same current flows through the n-type IGZO second drive transistor $IG_D$, the p-type first drive transistor $T_{DP}$, and the OLED. The current that flows through the n-type IGZO drive transistor is:

$$I_{dn} = \frac{\beta_{TDN}}{2}(V_{DAT} - V_x - V_{TH_n})^2$$

where $$\beta_{TDN} = \mu_{nn} \cdot C_{oxn} \cdot \frac{W_n}{L_n},$$

$C_{oxn}$ is the capacitance of the n-type IGZO drive transistor gate oxide;

$W_n$ is the width of the n-type IGZO drive transistor channel;

$L_n$ is the length of the n-type IGZO drive transistor channel (i.e. distance between source and drain); and $\mu_{nn}$ is the carrier mobility of the n-type IGZO drive transistor.

The current that flows through the p-type first drive transistor is $$I_{dp} = \frac{\beta_{TDP}}{2}(V_x - V_G - |V_{TH_{Tp}}|)^2$$

where $$\beta_{TDP} = \mu_{np} \cdot C_{oxp} \cdot \frac{W_p}{L_p},$$

$C_{oxp}$ is the capacitance of the p-type drive transistor gate oxide;

$W_p$ is the width of the p-type drive transistor channel;

$L_p$ is the length of the p-type drive transistor channel (i.e. distance between source and drain); and VG is the voltage at node G; and $\mu_{np}$ is the carrier mobility of the p-type drive transistor.

Similarly as in the previous embodiments, as $I_{dn}=I_{dp}=I_{OLED}$ and $V_G=V_{REF}-V_{THn}-|V_{THp}|$, the current flow through the OLED will be:

$$I_{OLED} = \frac{\beta_{TDN}\beta_{TDP}(V_{REF} - V_{DAT})^2}{2(\sqrt{\beta_{TDN}} + \sqrt{\beta_{TDP}})^2}$$

Accordingly, the current to the OLED does not depend on the threshold voltages of either the p-type first drive transistor $T_{DP}$ or the threshold voltage of the n-type IGZO second drive transistor $IG_D$, and hence the current to the OLED device $I_{OLED}$, is not affected by the threshold voltage variations of the drive transistors. In this manner, any variation in the threshold voltages of the drive transistors has been compensated. Similarly as in previous embodiments, the OLED current is not affected by the variations of the supplies ELVDD and ELVSS, such as an IR drop on such supply lines. In addition, the threshold compensation and data programming phases are independent of each other, and a short one horizontal time can be achieved with a short data programming phase. The short one horizontal time improves the responsiveness of the OLED.

In addition, by using IGZO transistor devices as switches, the leakage from storage capacitors C1 and C2 is greatly reduced. In particular, with IG1 as a switch between the gate and the drain of the p-type drive transistor, the leakage from the bottom plate of the storage capacitor C1 to the drain of the drive transistor is reduced. With IG2 as a switch between the VDAT voltage supply and the gate of the IGZO drive transistor, the leakage from the top plate of the storage capacitor C2 to the VDAT voltage supply is reduced. With IG3 as a switch between the reference voltage supply, VREF, and the gate of the IGZO drive transistor, the leakage from the top plate of the second storage capacitor C2 to the reference voltage supply is reduced. Hence, the voltages stored on the storage capacitors C1 and C2 can be retained for a longer time. As a result, as referenced above the refresh rate can be reduced as compared to conventional configurations, down to about 30 Hz or lower, which is particularly suitable for displaying static images.

Figure 9B:
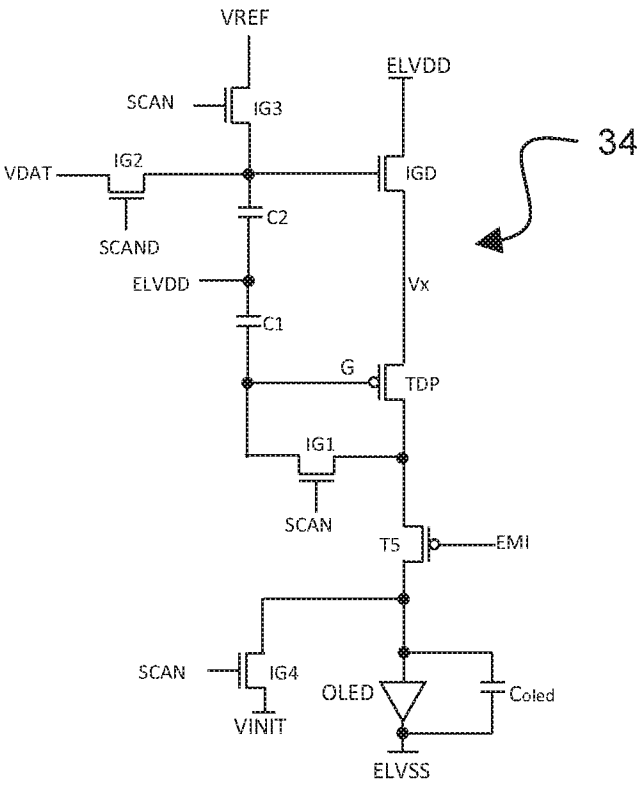
FIG. 9A and FIG. 9B are drawings depicting two circuit variations of the third circuit configuration of FIG. 7
Figure 9A:
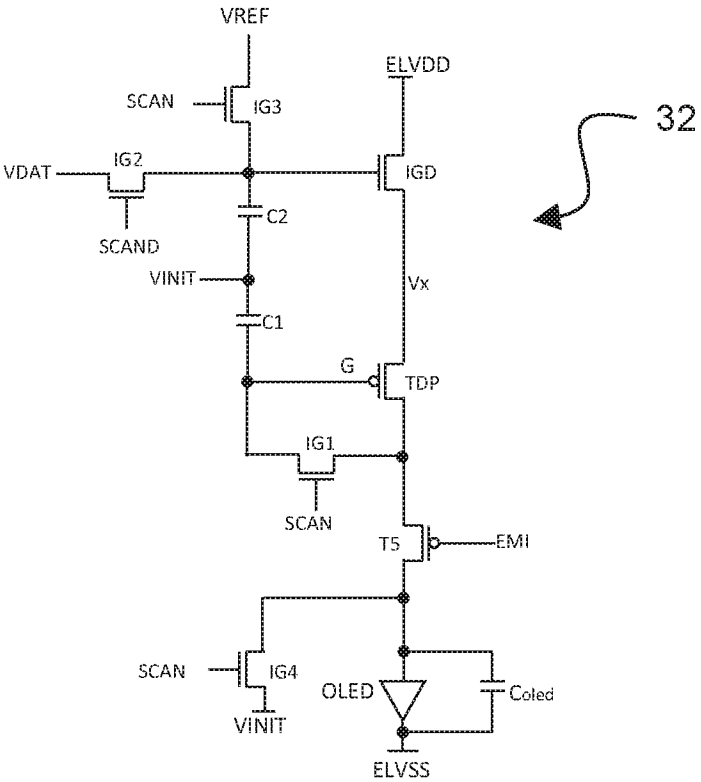

FIG. 9A and FIG. 9B are respective drawings depicting two circuit configurations 32 and 34 that are variations on the circuit configuration 30 of FIG. 7. The timing diagram of FIG. 8 is equally applicable for the circuit configurations 32 and 34. The difference between circuit configuration 30 and circuit configurations 32 and 34 (similarly as in previous embodiments) is the power supply that is connected to the node where the top plate of the first storage capacitor C1 and the bottom plate of the second storage capacitor C2 are connected. In the circuit configuration 30, such node is connected to the reference power supply line, VREF. In the circuit configuration 32 such node is connected to the initialization power supply line VINIT, and in the circuit configuration 34 such node is connected to the power supply ELVDD. In general, the node can be connected to any power supply with a fixed voltage level, which is available for the pixel, to set the voltage at the node between the capacitors relative to the gates of the drive transistors.

Figure 10:
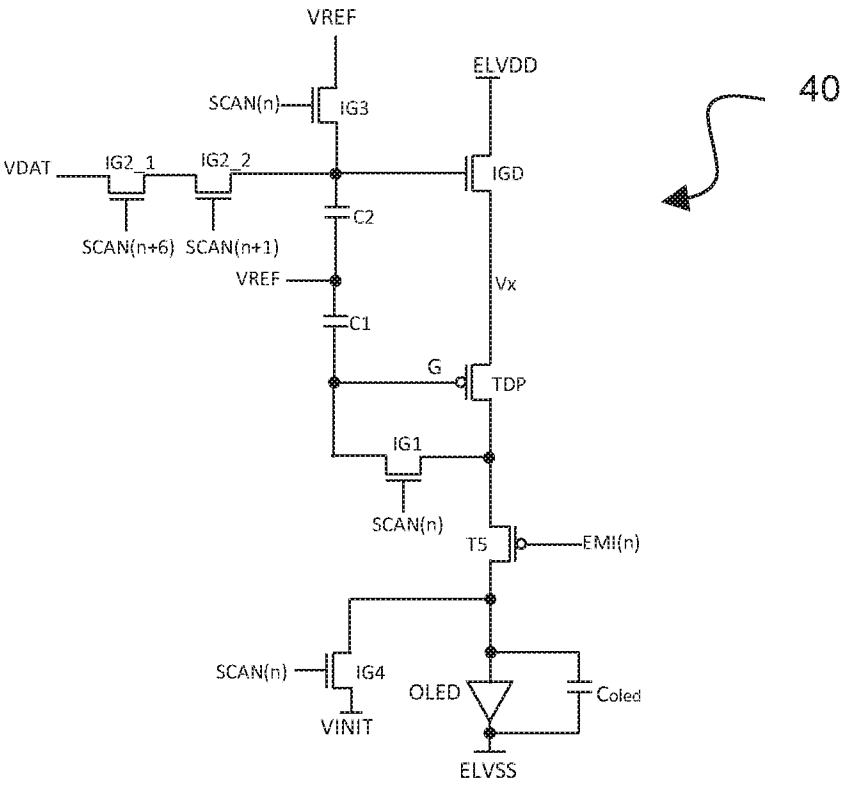
FIG. 10 is a drawing depicting a fourth circuit configuration in accordance with embodiments of the present application.
Figure 11:
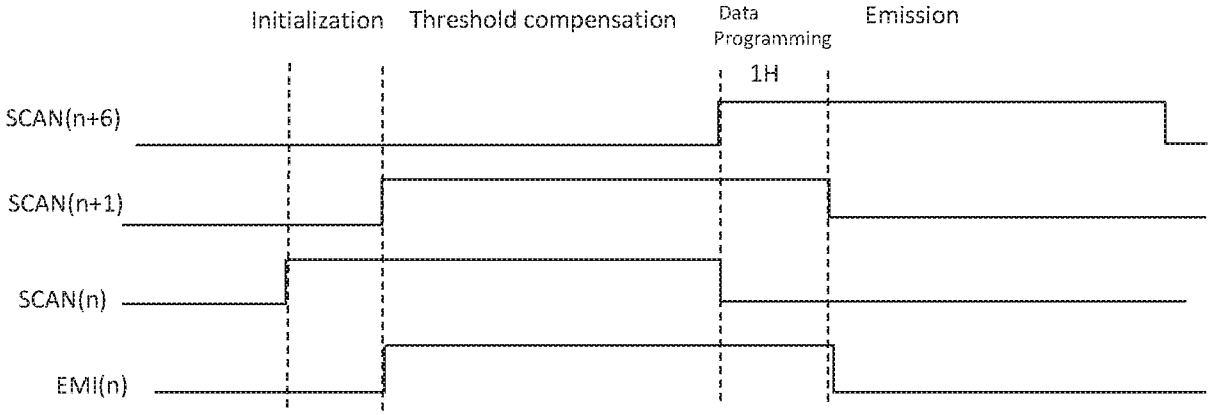
FIG. 11 is a drawing depicting a timing diagram associated with the operation of the circuit of FIG. 10.

FIG. 10 is a drawing depicting a fourth circuit configuration 40 in accordance with embodiments of the present application, and FIG. 11 is a timing diagram associated with the operation of the circuit configuration 40 of FIG. 10. In this example, similarly as in the previous third embodiment, FIG. 10 depicts the TFT circuit 40 configured with multiple p-type TFTs and n-type IGZO TFTs. $IG_D$ is an IGZO n-type drive transistor that is an analogue TFT; IG1, IG2_1, IG2_2, IG3 and IG4 are IGZO n-type digital switch TFTs; $T_{DP}$ is a p-type drive transistor that is an analogue TFT and T5 is a p-type digital switch TFT. C1 and C2 are capacitors and they are both storage capacitors. $C_{oled}$ is the internal capacitance of the OLED device (i.e., $C_{oled}$ is not a separate component, but is inherent to the OLED). The OLED further is connected to a power supply ELVSS as is conventional. In addition, although the embodiments are described principally in connection with an OLED as the light-emitting device, comparable principles may be used with display technologies that employ other types of light-emitting devices, including for example micro LEDs and quantum dot LEDs.

Referring to the TFT circuit 40 in combination with the timing diagram of FIG. 11, the TFT circuit 40 also operates to perform in four phases: an initialization phase, a compensation phase, a data programming phase, and an emission phase for light emission. The configuration of the components and operation of the circuit 40, therefore, is similar as to the operation of the circuit 30 of FIG. 7, except that the circuit 40 employs SCAN signals from other rows to replace the dedicated SCAND signal in the third embodiment, as further detailed below.

In this fourth embodiment, during the previous emission phase, the EMI(n) signal level has a low voltage value, so transistor T5 is on, and light emission is being driven by the input driving voltage ELVDD connected to the n-type IGZO second drive transistor $IG_D$, whereby the actual current applied to the OLED is determined by the voltages at the gate and the first terminal of the p-type first drive transistor. The SCAN(n) signal levels for the applicable rows initially have a low voltage value so IGZO transistors IG1, IG3, and IG4 are all in an off state. The SCAN(n+1) and SCAN(n+6) signal levels for the applicable rows initially have a low voltage value so transistors IG2_1 and IG2_2 are in an off state.

Next, at the beginning of the initialization phase, the SCAN(n) signal level is changed from a low voltage value to a high voltage value, causing transistors IG1, IG3, and IG4 to be turned on. As transistor IG1 is turned on, the gate and drain of the p-type first drive transistor $T_{DP}$ are connected together and the drive transistor $T_{DP}$ becomes diode-connected. As transistor IG3 is turned on, the reference voltage, VREF, is applied from the reference voltage line to the gate of the n-type IGZO second drive transistor $IG_D$. The reference voltage VREF is set to satisfy the equation below, such that VREF will be:

$$V_{REF} > V_{INIT} + |V_{THp}| + V_{THn}$$

where $V_{THp}$ the threshold voltage of the p-type first drive transistor, and $V_{THn}$ is the threshold voltage of the n-type IGZO second drive transistor. As transistor IG4 is turned on, the initialization voltage, VINIT, is applied from the initialization voltage line to the anode of the OLED. The VINIT voltage is set to lower than the threshold voltage of the OLED plus ELVSS, and thus the VINIT voltage does not cause light emission when applied at anode of the OLED. As T5 is on, the initialization voltage VINIT is also applied to the diode-connected gate and drain of the p-type first drive transistor and node G, where the bottom plate of the first storage capacitor C1 and the gate of the p-type first drive transistor are connected. The voltage at node Vx, where the source of the p-type first drive transistor and the source of the n-type IGZO second drive transistor are connected, is also pulled down by VINIT. At the end of initialization phase, the voltage level of Vx will be:

$$V_{INIT} + |V_{THp}| < V_x \leq V_{REF} - V_{THn}$$

At the end of the initialization phase, the SCAN(n+1) signal level is changed from a low voltage value to a high voltage value, causing transistor IG2_2 to be turned on and ready for the data programming phase, although the data voltage VDAT is not yet applied as IG2_1 remains in the off state.

The TFT circuit 40 next is operable in a threshold compensation phase, during which the threshold voltages of the p-type first drive transistor $T_{DP}$ and the n-type IGZO second drive transistor $IG_D$ are compensated. For such phase, the EMI(n) signal level is changed from a low voltage value to a high voltage value, causing transistor T5 to be turned off, and the diode-connected gate and drain of the p-type first drive transistor becomes floating. The voltage at node Vx becomes floating as well. During the threshold compensation, the Vx voltage will be pulled up towards $V_{REF}-V_{THn}$ as the n-type IGZO second drive transistor $IG_D$ is turning off. The voltage at node G, where the gate of the diode-connected p-type first drive transistor and the bottom plate of the first storage capacitor C1 are connected, will be pulled up towards $V_x-|V_{THp}|$ as the p-type first drive transistor $T_{DP}$ is turning off.

At the end of the threshold compensation phase, the SCAN(n) signal level is changed from a high voltage value to a low voltage value, causing transistors IG1, IG3, and IG4 to be turned off. As transistor IG1 is turned off, the gate and the drain of the p-type first drive transistor $T_{DP}$ are disconnected and the p-type drive transistor $T_{DP}$ is no longer diode-connected. The voltage at node G is $V_{REF}-V_{TH}-|V_{THp}|$. The threshold voltages of the n-type IGZO second drive transistor $IG_D$ and the p-type first drive transistor $T_{DP}$ are stored on the bottom plate of the first storage capacitor C1 with the top plate of C1 being connected to the reference voltage line VREF. With transistor IG3 turned off, the gate of the n-type IGZO second drive transistor $IG_D$ is disconnected from the reference voltage line, VREF. With transistor IG4 turned off, the anode of the OLED is disconnected from the initialization voltage line, VINIT.

The TFT circuit 40 next is operable in a data programming phase. The SCAN(n+6) signal level is changed from the low voltage value to the high voltage value, causing transistor IG2_1 to be turned on. As described above, the transistor IG2_2 is already turned on at the end of the initialization phase. The data voltage line VDAT is thus electrically connected to the second storage capacitor C2 and the gate of the n-type IGZO second drive transistor $IG_D$. The data voltage, VDAT, is changed from the value for another pixel (e.g. the previous row of the display DATA (n−1)) to the data value for the current pixel (e.g. the current row of the display DATA(n)), which is applied from the data voltage line to the top plate of the storage capacitor C2 with the bottom plate of C2 being connected to the reference voltage, VREF.

For the programming phase, SCAN signals applied to different rows (e.g., SCAN(n+1) and SCAN(n+6)) are employed to electrically connect the data voltage line VDAT to the top plate of the programming capacitor C2. By using SCAN signals from different rows in combination, a short programming pulse results from overlap of the SCAN signals, thereby minimizing the 1H time as shown in the timing diagram of FIG. 11. Although in this embodiment the SCAN (n+1) and SCAN (n+6) are used to control the switch transistors IG2_2 and IG2_1 to generate the short programming pulse, the SCAN signals from other rows can be used. This embodiment has an advantage of using existing SCAN signal lines, but requires the two transistors IG_2 and IG2_1 to connect VDAT to the programming capacitor C2 during the programming phase. In contrast, the previous embodiment employs an additional dedicated scan line SCAND, but uses only a single transistor IG2 to apply the data voltage. Similarly as with previous embodiments having such difference, the two alternative configurations, represent a trade-off between an additional scan control line versus an additional transistor as may be suitable for a given application.

At the end of the data programming phase, the SCAN(n+1) signal level is changed from the high voltage value to the low voltage value, causing transistor IG2_2 to be turned off. The gate of the n-type IGZO second drive transistor $IG_D$ and the top plate of the capacitor C2 are disconnected from the data voltage line, VDAT. VDAT will change to a corresponding value for the next row data programming.

The TFT circuit 40 next is operable in an emission phase during which the OLED is capable of emitting light. The EMI(n) signal is changed from the high voltage value to the low voltage value, causing transistor T5 to be turned on. As transistor T5 is turned on, the drain of the p-type first drive transistor $T_{DP}$ is connected to anode of the OLED. As in previous embodiments, the same current flows through the n-type IGZO second drive transistor $IG_D$, the p-type first drive transistor $T_{DP}$, and the OLED. The current that flows through the n-type second drive transistor is:

$$I_{dn} = \frac{\beta_{TDN}}{2}(V_{DAT} - V_x - V_{TH_n})^2$$

The current that flows through the p-type first drive transistor is:

$$I_{dp} = \frac{\beta_{TDP}}{2}(V_G - V_x - V_{TH_{Tp}})^2$$

Similarly as in previous embodiments, as $I_{dn}=I_{dp}=I_{OLED}$ and $V_G=V_{REF}-V_{THn}-|V_{THp}|$, the current flow through the OLED will be:

$$I_{OLED} = \frac{\beta_{TDN}\beta_{TDP}(V_{REF} - V_{DAT})^2}{2(\sqrt{\beta_{TDN}} + \sqrt{\beta_{TDP}})^2}$$

Accordingly, the current to the OLED does not depend on the threshold voltage of the p-type drive transistor $T_{DP}$ and the threshold voltage of the n-type IGZO drive transistor $IG_D$, and hence the current to the OLED device $I_{OLED}$ is not affected by the threshold voltage variations of the drive transistors. In this manner, variations in the threshold voltage of the drive transistors have been compensated. Similarly as in previous embodiments, the OLED current is not affected by the variations of the voltage supplies ELVDD and ELVSS, such as the IR drop on the supply lines. In addition, the threshold compensation and data programming operations are independent of each other, and a short one horizontal time can be achieved with a short data programming phase. The short one horizontal time improves the responsiveness of the OLED. Furthermore, by using IGZO devices as switches, the leakage from storage capacitors C1 and C2 is greatly reduced. As a result, the refresh rate can be reduced as compared to conventional configurations, down to about 30 Hz or lower, which is particularly suitable for displaying static images.

Figure 12B:
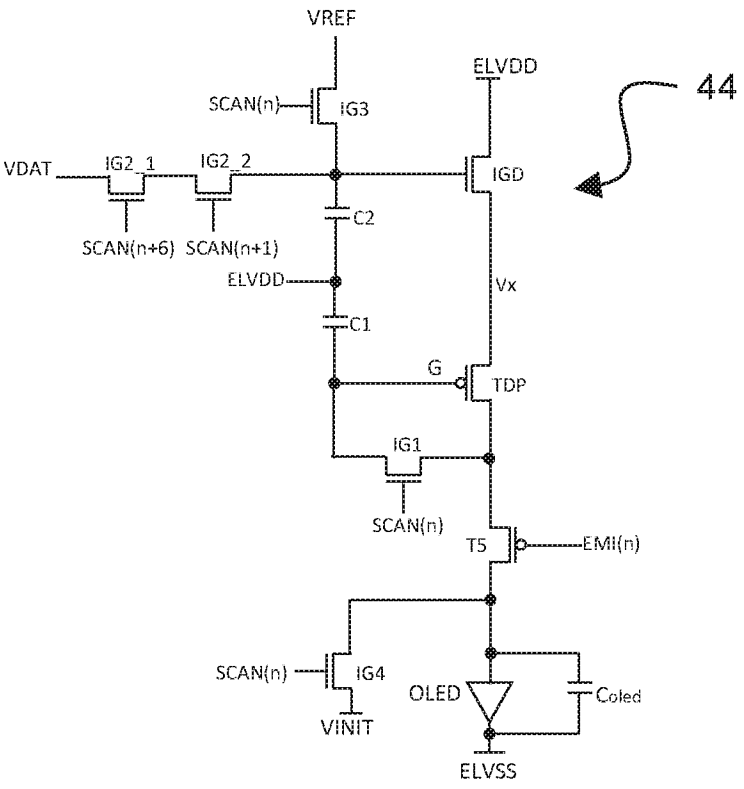
FIG. 12A and FIG. 12B are drawings depicting two circuit variations of the fourth circuit configuration of FIG. 10.
Figure 12A:
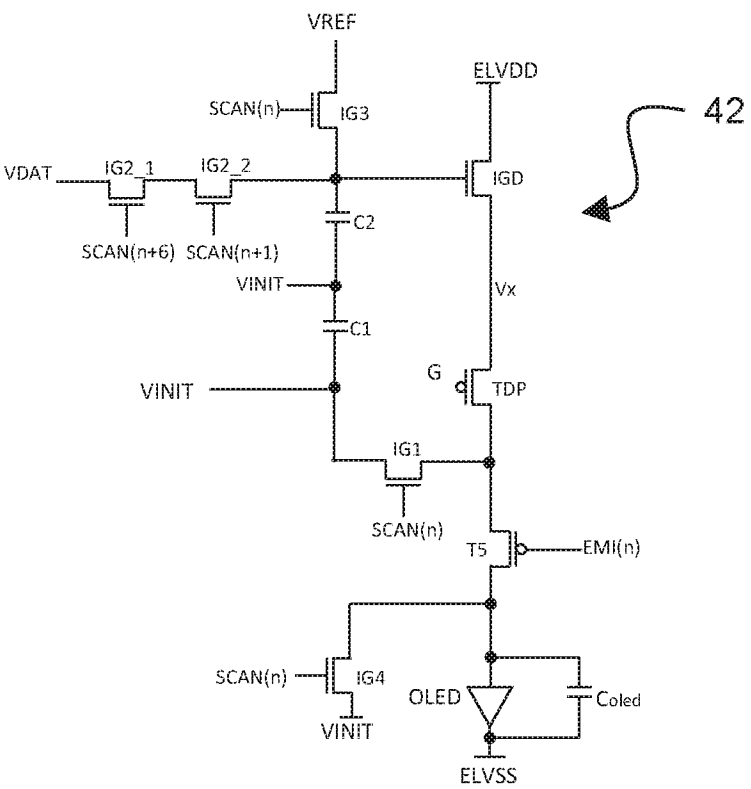

FIG. 12A and FIG. 12B are respective drawings depicting two circuit configurations 42 and 44 that are variations on the circuit configuration 40 of FIG. 10. The timing diagram of FIG. 11 is equally applicable for the circuit configurations 42 and 44. The difference between circuit configuration 40 and circuit configurations 42 and 44 (similarly as in previous embodiments) is the power supply that is connected to the node where the top plate of the first storage capacitor C1 and the bottom plate of the second storage capacitor C2 are connected. In the circuit configuration 40, such node is connected to the reference power supply line, VREF. In the circuit configuration 42 such node is connected to the initialization power supply line VINIT, and in the circuit configuration 44 such node is connected to the power supply ELVDD. In general, the node can be connected to any power supply with a fixed voltage level, which is available for the pixel, to set the voltage at the node between the capacitors relative to the gates of the drive transistors.

Figure 13:
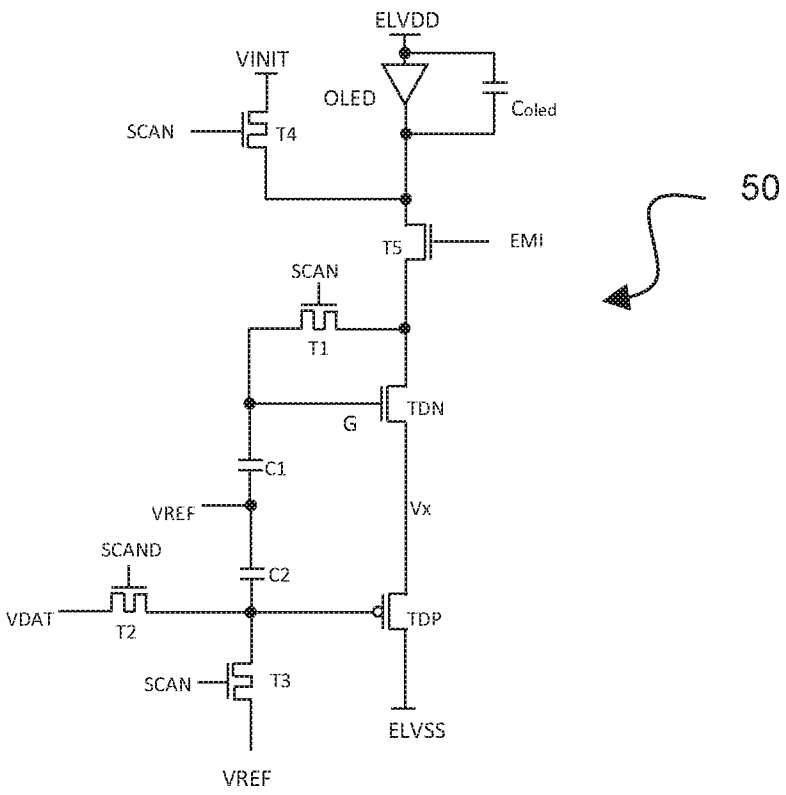
FIG. 13 is a drawing depicting a fifth circuit configuration in accordance with embodiments of the present application.
Figure 14:
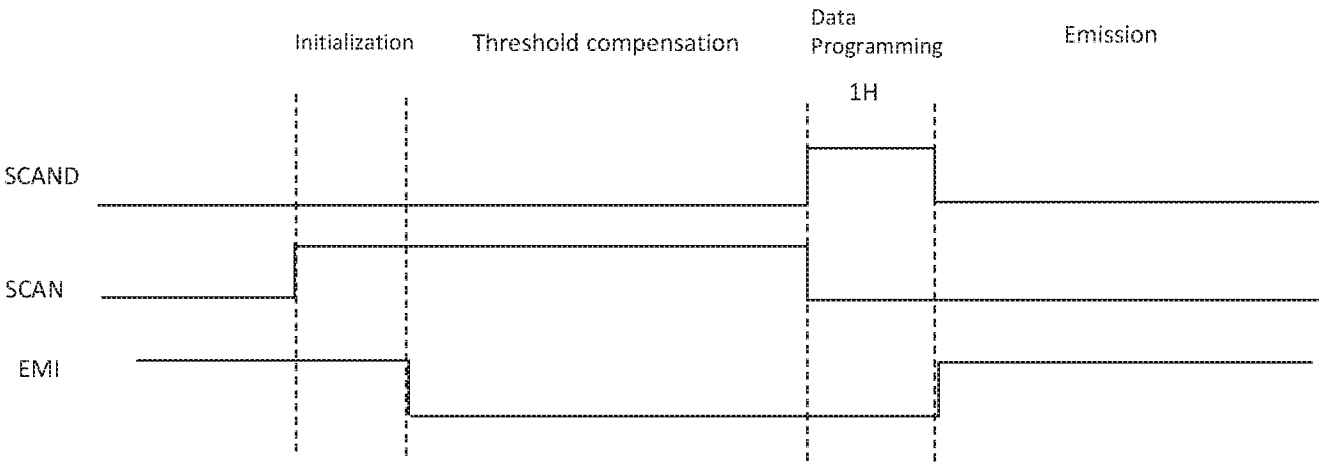
FIG. 14 is a drawing depicting a timing diagram associated with the operation of the circuit of FIG. 13.

FIG. 13 is a drawing depicting a fifth circuit configuration 50 in accordance with embodiments of the present application, and FIG. 14 is a timing diagram associated with the operation of the circuit configuration 50 of FIG. 13. In this example, the circuit 50 is configured as a thin film transistor (TFT) circuit that includes multiple n-type transistors $T_{DN}$, T1, T2, T3, T4, T5, a p-type transistor $T_{DP}$ and two capacitors C1 and C2. In this exemplary embodiment, T1, T2, T3 and T4 are double-gate TFTs as an exemplary embodiment, which have low leakage between the source and drain, although T1-T4 each alternatively may be a single gate TFT.

More specifically, FIG. 13 depicts the TFT circuit 50 configured with multiple n-type TFTs and one p-type TFT. $T_{DN}$ is an n-type first drive transistor that is an analogue TFT, T2-T5 are n-type digital switch TFTs, and $T_{DP}$ is a p-type second drive transistor that is an analogue TFT. As referenced above, C1 and C2 are capacitors and they are both storage capacitors. $C_{oled}$ is the internal capacitance of the OLED device (i.e., $C_{oled}$ is not a separate component, but is inherent to the OLED). The OLED further is connected to a power supply ELVDD as is conventional. In addition, although the embodiments are described principally in connection with an OLED as the light-emitting device, comparable principles may be used with display technologies that employ other types of light-emitting devices, including for example micro LEDs and quantum dot LEDs.

Referring to the TFT circuit 50 of FIG. 13 in combination with the timing diagram of FIG. 14, the TFT circuit 50 operates to perform in four phases: an initialization phase, a threshold compensation phase, a data programming phase, and an emission phase for light emission. The circuit configuration 50 of FIG. 13 operates comparably as the circuit configuration 10 of FIG. 1, except that the circuit configuration 50 substitutes n-type transistors rather than p-type transistors as the digital switch transistors. In addition, the first drive transistor $T_{DN}$ is configured as an n-type transistor and the second drive transistor $T_{DP}$ is configured as a p-type transistor. With this configuration, the p-type drive transistor operates as the source follower, and the n-type drive transistor operates as the main drive transistor that controls the current level to the OLED. As is known in the art, the drive properties of an OLED may be more suitable for one or other of p-type versus n-type transistors, and the principles of the present invention are applicable to either type of configuration.

In this fifth embodiment, during the previous emission phase, the EMI signal level has a high voltage value, so transistor T5 is on, and light emission is being driven by the input driving voltage ELVSS connected the p-type second drive transistor $T_{DP}$, whereby the actual current applied to the OLED is determined by the voltages at the gate and the first terminal of the n-type first drive transistor $T_{DN}$. The SCAN signal level for the applicable rows initially has a low voltage value so transistors T1, T3, and T4 are all in an off state. The SCAND signal level for the applicable rows initially has a low voltage value so transistor T2 is in an off state.

Next, at the beginning of the initialization phase, the SCAN signal level is changed from a low voltage value to a high voltage value, causing transistors T1, T3, and T4 to be turned on. As transistor T1 is turned on, the gate and drain of the n-type first drive transistor $T_{DN}$ are connected together and the drive transistor $T_{DN}$ becomes diode-connected. As transistor T3 is turned on, the reference voltage, VREF, is applied from the reference voltage line to the gate of the p-type second drive transistor $T_{DP}$. The reference voltage VREF is set to satisfy the equation below, and thus VREF will be:

$$V_{REF}<V_{INIT}-|V_{THp}|-V_{THn}$$

where $V_{THp}$ is the threshold voltage of the p-type second drive transistor $T_{DP}$ and $V_{THn}$ is the threshold voltage of the n-type first drive transistor $T_{DN}$. As transistor T4 is turned on, the initialization voltage, VINIT, is applied from the initialization voltage line to the cathode of the OLED. The VINIT voltage is set to higher than the supply ELVDD minus the threshold voltage of the OLED, and thus the VINIT voltage does not cause light emission when applied at cathode of the OLED. As T5 is on, the initialization voltage VINIT is also applied to the diode-connected gate and drain of the n-type first drive transistor and node G, where the top plate of the first storage capacitor C1 and the gate of the n-type drive first transistor are connected. The voltage at node Vx, where the source of the p-type second drive transistor and the source of the n-type first drive transistor are connected, is also pulled up by VINIT. At the end of initialization phase, the voltage level of Vx will be:

$$V_{REF}+|V_{THp}|\leq V_x<V_{INIT}-V_{THn}$$

The TFT circuit 50 next is operable in a threshold compensation phase, during which the threshold voltages of the p-type second drive transistor $T_{DP}$ and n-type first drive transistor $T_{DN}$ are compensated. For such phase, the EMI signal level is changed from a high voltage value to a low voltage value, causing transistor T5 to be turned off, and the diode-connected gate and drain of the n-type first drive transistor becomes floating. The voltage at node Vx becomes floating as well. During the threshold compensation, the Vx voltage will be pulled down towards $V_{REF}+I_{THp}$ as the p-type second drive transistor $T_{DP}$ is turning off. The voltage at node G, where the gate of the diode-connected n-type first drive transistor and the top plate of the first storage capacitor C1 are connected, will be pulled down towards $V_x+V_{THn}$ as the n-type drive transistor $T_{DN}$ is turning off.

At the end of the threshold compensation phase, the SCAN signal level is changed from a high voltage value to a low voltage value, causing transistors T1, T3, and T4 to be turned off. As transistor T1 is turned off, the gate and the drain of the n-type first drive transistor $T_{DN}$ are disconnected and the n-type drive transistor $T_{DN}$ is no longer diode-connected. The voltage at node G is $V_{REF}+V_{TH}n+|V_{THp}|$. The threshold voltages of the n-type first drive transistor $T_{DN}$ and the p-type second drive transistor $T_{DP}$ are stored on the top plate of the first storage capacitor C1 with the bottom plate of C1 being connected to the reference voltage line VREF. With transistor T3 turned off, the gate of the p-type second drive transistor $T_{DP}$ is disconnected from the reference voltage line VREF. With transistor T4 turned off, the cathode of the OLED is disconnected from the initialization voltage line VINIT.

The TFT circuit 50 next is operable in a data programming phase. The SCAND signal level is changed from the low voltage value to the high voltage value, causing transistor T2 to be turned on, which electrically connects the data voltage line VDAT to the bottom plate of the second storage capacitor C2 and the gate of the p-type second drive transistor $T_{DP}$. The data voltage, VDAT, is changed from the value for another pixel (e.g. the previous row of the display DATA(n−1)) to the data value for the current pixel (e.g. the current row of the display DATA(n)), which is applied from the data voltage line to the bottom plate of the second storage capacitor C2 with the top place of C2 being connected to the reference voltage line VREF.

At the end of the data programming phase, the SCAND signal level is changed from the high voltage value to the low voltage value, causing transistor T2 to be turned off. The gate of the p-type second drive transistor $T_{DP}$ and the bottom plate of the second capacitor C2 are disconnected from the data voltage line, VDAT. VDAT will change to a corresponding value for the next row data programming.

The TFT circuit 50 next is operable in an emission phase during which the OLED is capable of emitting light. The EMI signal is changed from the low voltage value to the high voltage value, causing transistor T5 to be turned on. As transistor T5 is turned on, the drain of the n-type first drive transistor $T_{DN}$ is connected to the cathode of the OLED. Similarly as in previous embodiments, the same current flows through the n-type first drive transistor $T_{DN}$, the p-type second drive transistor $T_{DP}$, and the OLED. The current that flows through the n-type first drive transistor is:

$$I_{dn}=\frac{\beta_{TDN}}{2}(V_G-V_x-V_{TH_n})^2$$

The current that flows through the p-type second drive transistor is:

$$I_{dp}=\frac{\beta_{TDP}}{2}(V_x-V_{DAT}-|V_{TH_{Tp}}|)^2$$

Because as referenced above $I_{dn}=I_{dp}$ $$\frac{\beta_{TDN}}{2}(V_G-V_x-V_{TH_n})^2=\frac{\beta_{TDP}}{2}(V_x-V_{DAT}-|V_{TH_p}|)^2$$

$$\Rightarrow\sqrt{\beta_{TDN}}(V_G-V_x-V_{TH_n})=\sqrt{\beta_{TDP}}(V_x-V_{DAT}-|V_{TH_p}|)$$

$$\text{As}\,V_G=V_{REF}+v_{THn}+|v_{THp}|$$

$$\Rightarrow\sqrt{\beta_{TDN}}(V_{REF}-V_x+|V_{THp}|)=\sqrt{\beta_{TDP}}(V_x-V_{DAT}-|V_{TH_p}|)$$

$$\Rightarrow V_x=\frac{\sqrt{\beta_{TDN}}V_{DAT}+\sqrt{\beta_{TDP}}V_{REF}}{\sqrt{\beta_{TDN}}+\sqrt{\beta_{TDP}}}+|V_{THp}|$$

$$\Rightarrow I_{dn}=\frac{\beta_{TDN}}{2}\left(V_{REF}-\left(\frac{\sqrt{\beta_{TDN}}V_{DAT}+\sqrt{\beta_{TDP}}V_{REF}}{\sqrt{\beta_{TDN}}+\sqrt{\beta_{TDP}}}|V_{THp}|\right)+|V_{THp}|\right)^2$$

$$=\frac{\beta_{TDN}\beta_{TDP}(V_{REF}-V_{DAT})^2}{2(\sqrt{\beta_{TDN}}+\sqrt{\beta_{TDP}})^2}$$

As $I_{OLED}=I_{dn}=I_{dp}$ $$I_{OLED} = \frac{\beta_{TDN}\beta_{TDP}(V_{REF} - V_{DAT})^2}{2(\sqrt{\beta_{TDN}} + \sqrt{\beta_{TDP}})^2}$$

Accordingly, the current to the OLED does not depend on the threshold voltage of the p-type second drive transistor $T_{DP}$ and the threshold voltage of the n-type first drive transistor $T_{DN}$, and hence the current to the OLED device $I_{OLED}$ is not affected by the threshold voltage variations of the drive transistors. In this manner, variation in the threshold voltage of the drive transistor has been compensated.

In accordance with the above, the p-type second drive transistor $T_{DP}$ isolates power supply ELVSS from the n-type first drive transistor. The p-type drive transistor thus functions as a source follower. The source voltage of the p-type second drive transistor $T_{DP}$ at node Vx, which is also the source voltage of the n-type first drive transistor $T_{DN}$, is only related to the gate voltage of the p-type second drive transistor $T_{DP}$. The p-type source follower is designed not to limit the current from the supply ELVSS to the OLED. The n-type drive transistor will control or limit the current to the OLED, and the current is related to the gate voltage of the n-type transistor and Vx voltage. As Vx is isolated from the power supply ELVSS, the current to the OLED, which is controlled by the n-type drive transistor $T_{DN}$, is not affected by the variations of the supply ELVSS, such as an IR drop on that supply line. The n-type drive transistor is inherently immune from the drain voltage (the power supply ELVDD) variations at least in first order. Similarly as in previous embodiments, the threshold compensation and data programming phases are independent of each other, and a short one horizontal time can be achieved with a short data programming phase. The short one horizontal time improves the responsiveness of the OLED.

Figure 15B:
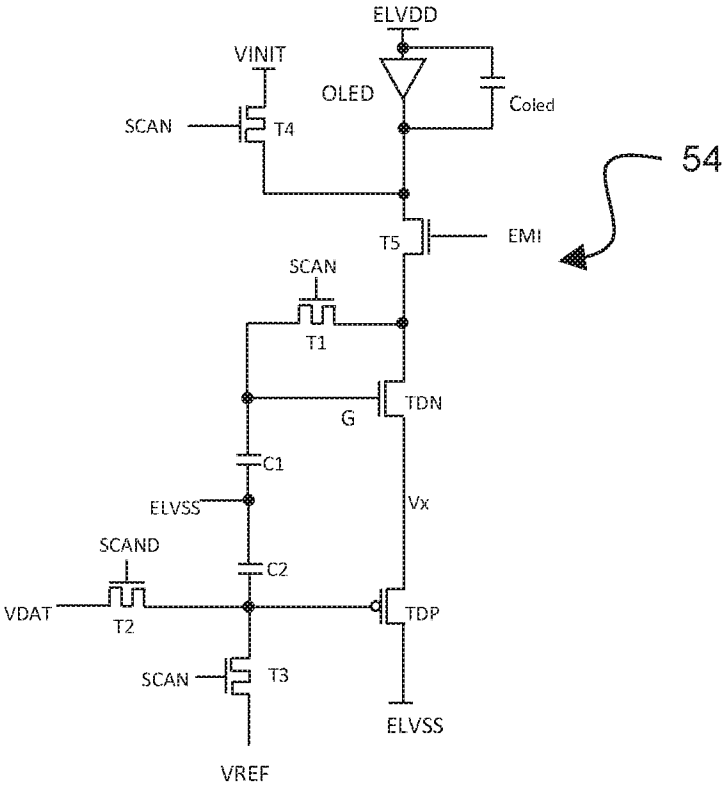
FIG. 15A and FIG. 15B are drawings depicting two circuit variations of the fifth circuit configuration of FIG. 13.
Figure 15A:
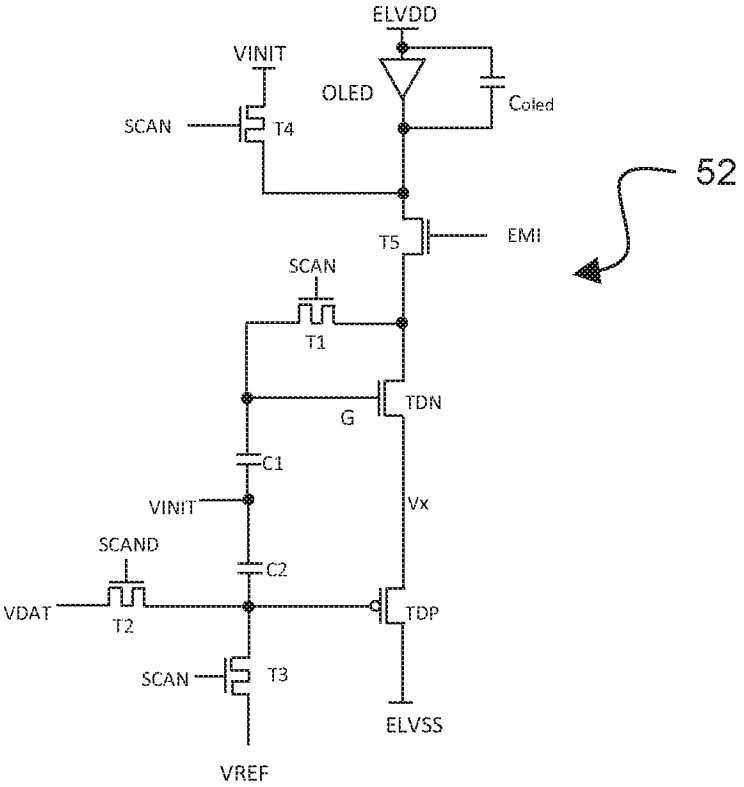

FIG. 15A and FIG. 15B are respective drawings depicting two circuit configurations 52 and 54 that are variations on the circuit configuration 50 of FIG. 13. The timing diagram of FIG. 14 is equally applicable for the circuit configurations 52 and 54. The difference between circuit configuration 50 and circuit configurations 52 and 54 (similarly as in previous embodiments) is the power supply that is connected to the node where the bottom plate of the first storage capacitor C1 and the top plate of the second storage capacitor C2 are connected. In the circuit configuration 50, such node is connected to the reference power supply line, VREF. In the circuit configuration 52 such node is connected to the initialization power supply line VINIT, and in the circuit configuration 54 such node is connected to the power supply ELVSS. In general, the node can be connected to any power supply with a fixed voltage level, which is available for the pixel, to set the voltage at the node between the capacitors relative to the gates of the drive transistors.

Figure 16:
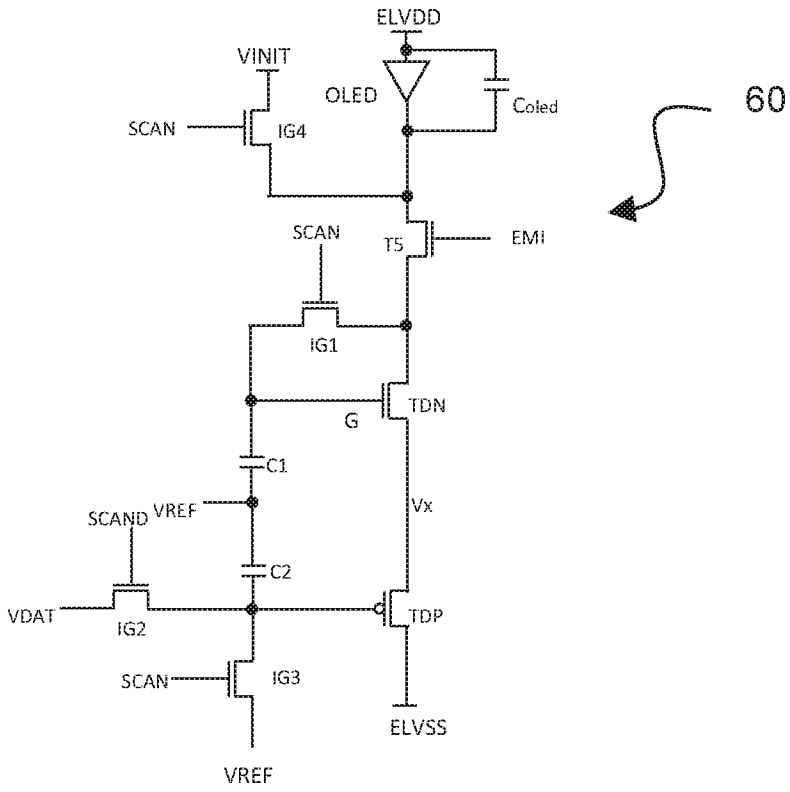
FIG. 16 is a drawing depicting a sixth circuit configuration in accordance with embodiments of the present application.

FIG. 16 is a drawing depicting a sixth circuit configuration 60 in accordance with embodiments of the present invention which comparable to the circuit configuration of FIG. 13, and thus FIG. 14 also is applicable as a timing diagram associated with the operation of the circuit configuration 60 of FIG. 16. In this example, the circuit 60 uses ultra-low leakage oxide transistors, such as indium gallium zinc oxide (IGZO) devices, as the data switch device and switches associated with the storage capacitors. This permits the stored data voltage and threshold voltage to be retained longer on the capacitors due to the ultra-low off leakage property of the ultra-low leakage transistors. As a result, the refresh rate can be reduced as compared to conventional configurations, down to about 30 Hz or lower, which is particularly suitable for displaying static images.

Similarly as circuit configuration 50, FIG. 16 depicts the TFT circuit 50 configured with multiple n-type TFTs and one p-type TFT. $T_{DN}$ is an n-type first drive transistor that is an analogue TFT, IG1-IG4 and T5 are n-type digital switch TFTs, and $T_{DP}$ is a p-type second drive transistor that is an analogue TFT. As referenced above, C1 and C2 are capacitors and they are both storage capacitors. $C_{oled}$ is the internal capacitance of the OLED device (i.e., $C_{oled}$ is not a separate component, but is inherent to the OLED). The OLED further is connected to a power supply ELVDD as is conventional. The principal difference between the circuit configuration 60 and the circuit configuration 50 is that the dual gate switch TFTs T1-T4 in the circuit configuration 50 are replaced by ultra-low leakage IGZO TFTs IG1-IG4 in the circuit configuration 60. The timing and operations of the circuit configuration 60 are essentially the same as the timing and operations of circuit configuration 50. In addition, the n-type transistor T5 and the first drive transistor $T_{DN}$ can also be IGZO devices. The production cost may be reduced if all the n-type transistors are manufactured as the same type.

Figure 17:
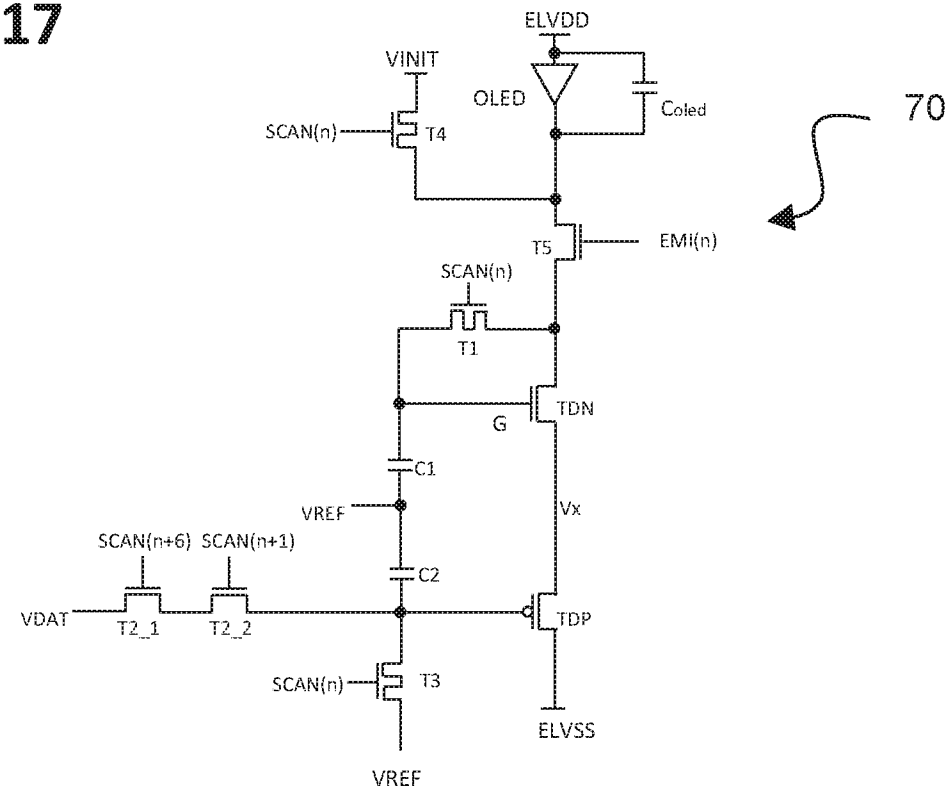
FIG. 17 is a drawing depicting a seventh circuit configuration in accordance with embodiments of the present application.
Figure 18:
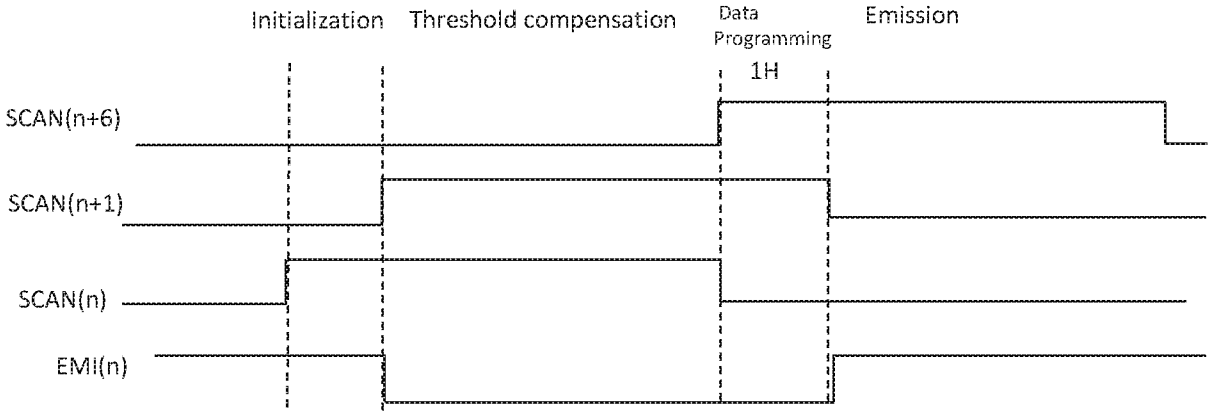
FIG. 18 is a drawing depicting a timing diagram associated with the operation of the circuit of FIG. 17.

FIG. 17 is a drawing depicting a seventh circuit configuration 70 in accordance with embodiments of the present application, and FIG. 18 is a timing diagram associated with the operation of the circuit configuration 70 of FIG. 17. In this example, similarly as in the fifth embodiment, the circuit 70 is configured as a thin film transistor (TFT) circuit that includes multiple n-type transistors $T_{DN}$, T1, T2_1, T2_2, T3, T4, T5, a p-type transistor $T_{DP}$, and two capacitors C1 and C2. In this exemplary embodiment, T1, T3 and T4 are double-gate TFTs as an exemplary embodiment, which have low leakage between the source and drain, although T1, T3, and T4 each alternatively may be a single gate TFT. $C_{oled}$ is the internal capacitance of the OLED device (i.e., $C_{oled}$ is not a separate component, but is inherent to the OLED). The OLED further is connected to a power supply ELVDD as is conventional. In addition, although the embodiments are described principally in connection with an OLED as the light-emitting device, comparable principles may be used with display technologies that employ other types of light-emitting devices, including for example micro LEDs and quantum dot LEDs.

Referring to the TFT circuit 70 in combination with the timing diagram of FIG. 18, the TFT circuit 70 also operates to perform in four phases: an initialization phase, a compensation phase, a data programming phase, and an emission phase for light emission. The configuration of the components and operation of the circuit 70, therefore, is similar as to the operation of the circuit 50 of FIG. 13, except that the circuit 70 employs SCAN signals from other rows to replace the dedicated SCAND signal in the fifth embodiment, as further detailed below.

In this seventh embodiment, during the previous emission phase, the EMI(n) signal level has a high voltage value, so transistor T5 is on, and light emission is being driven by the input driving voltage ELVSS connected to the p-type second drive transistor $T_{DP}$, whereby the actual current applied to the OLED is determined by the voltages at the gate and the first terminal of n-type first drive transistor $T_{DN}$. The SCAN (n) signal level for the applicable rows initially has a low voltage value so transistors T1, T3, and T4 are all in an off state. The SCAN(n+1) and SCAN(n+6) signal levels for the applicable rows initially have a low voltage value so transistors T2_1 and T2_2 are in an off state.

Next, at the beginning of the initialization phase, the SCAN(n) signal level is changed from a low voltage value to a high voltage value, causing transistors T1, T3, and T4 to be turned on. As transistor T1 is turned on, the gate and drain of the n-type first drive transistor $T_{DN}$ are connected together and the drive transistor $T_{DN}$ becomes diode-connected. As transistor T3 is turned on, the reference voltage, VREF, is applied from the reference voltage line to the gate of the p-type second drive transistor $T_{DP}$. The reference voltage VREF is set to satisfy the equation below, such that VREF will be:

$$V_{REF}<V_{INIT}-|V_{THp}|-V_{THn}$$

where $V_{THp}$ is the threshold voltage of the p-type second drive transistor $T_{DP}$ and $V_{THn}$ is the threshold voltage of the n-type first drive transistor $T_{DN}$. As transistor T4 is turned on, the initialization voltage, VINIT, is applied from the initialization voltage line to the cathode of the OLED. The VINIT voltage is set to higher than the supply voltage ELVDD minus the threshold voltage of the OLED, and thus the VINIT voltage does not cause light emission when applied at cathode of the OLED. As T5 is on, the initialization voltage VINIT is also applied to the diode-connected gate and drain of the n-type first drive transistor and node G, where the top plate of the first storage capacitor C1 and the gate of the n-type first drive transistor are connected. The voltage at node Vx, where the source of the p-type second drive transistor and the source of the n-type first drive transistor are connected, is also pulled up by VINIT. At the end of initialization phase, the voltage level of Vx will be:

$$V_{REF}+|V_{THp}|\leq V_x<V_{INIT}-V_{THn}$$

At the end of the initialization phase, the SCAN(n+1) signal level is changed from a low voltage value to a high voltage value, causing transistor T2_2 to be turned on and ready for the data programming phase. The data voltage VDAT, however, is not applied at this time as the transistor T2_1 remains in the off state.

The TFT circuit 70 next is operable in a threshold compensation phase, during which the threshold voltages of the p-type second drive transistor $T_{DP}$ and the n-type first drive transistor $T_{DN}$ are compensated. For such phase, the EMI(n) signal level is changed from a high voltage value to a low voltage value, causing transistor T5 to be turned off, and the diode-connected gate and drain of the n-type first drive transistor becomes floating. The voltage at node Vx becomes floating as well. During the threshold compensation phase, the Vx voltage will be pulled down towards $V_{REF}+I_{THp}$ as the p-type second drive transistor $T_{DP}$ is turning off. The voltage at node G, where the gate of the diode-connected n-type first drive transistor and the top plate of the first storage capacitor C1 are connected, will be pulled down towards $V_x+V_{THn}$ as the n-type first drive transistor $T_{DN}$ is turning off.

At the end of the threshold compensation phase, the SCAN(n) signal level is changed from a high voltage value to a low voltage value, causing transistors T1, T3, and T4 to be turned off. As transistor T1 is turned off, the gate and the drain of the n-type first drive transistor $T_{DN}$ are disconnected and the n-type drive transistor $T_{DN}$ is no longer diode-connected. The voltage at node G is $V_{REF}+V_{THn}+|V_{THp}|$. The threshold voltages of the n-type first drive transistor $T_{DN}$ and the p-type second drive transistor $T_{DP}$ are stored on the top plate of the first storage capacitor C1 with the bottom plate of C1 being connected to the reference voltage line VREF. With transistor T3 turned off, the gate of the p-type second drive transistor $T_{DP}$ is disconnected from the reference voltage line VREF. With transistor T4 turned off, the cathode of the OLED is disconnected from the initialization voltage line VINIT.

The TFT circuit 70 next is operable in a data programming phase. The SCAN(n+6) signal level is changed from the low voltage value to the high voltage value, causing transistor T2_1 to be turned on. As described above, the transistor T2_2 is already turned on at the end of the initialization phase. The data voltage line VDAT is thus electrically connected to the second storage capacitor C2 and the gate of the p-type second drive transistor $T_{DP}$. The data voltage, VDAT, is changed from the value for another pixel (e.g. the previous row of the display DATA(n−1)) to the data value for the current pixel (e.g. the current row of the display DATA(n)), which is applied from the data voltage line to the bottom plate of the second storage capacitor C2 with the top plate of C2 connected to the reference voltage line VREF.

For the programming phase, SCAN signals applied to different rows (e.g., SCAN(n+1) and SCAN(n+6)) are employed to electrically connect the data voltage line VDAT to the bottom plate of the second capacitor C2. By using SCAN signals from different rows in combination, a short programming pulse results from overlap of the SCAN signals, thereby minimizing the 1H time as shown in the timing diagram of FIG. 18. Although in this embodiment the SCAN (n+1) and SCAN (n+6) are used to control the switch transistors T2_2 and T2_1 to generate the short programming pulse, the SCAN signals from other rows can be used. This embodiment has an advantage of using existing SCAN signal lines, but requires the two transistors T2_2 and T2_1 to connect VDAT to the programming capacitor C2 during the programming phase. In contrast, the previous embodiment employs an additional dedicated scan line SCAND, but uses only a single transistor T2 to apply the data voltage. Similarly as with previous embodiments having such difference, the two alternative configurations represent a trade-off between an additional scan control line versus an additional transistor as may be suitable for a given application.

At the end of the data programming phase, the SCAN(n+1) signal level is changed from the high voltage value to the low voltage value, causing transistor T2_2 to be turned off. The gate of the p-type second drive transistor $T_{DP}$ and the bottom plate of the second capacitor C2 are disconnected from the data voltage line, VDAT. VDAT will change to a corresponding value for the next row data programming.

The TFT circuit 70 next is operable in an emission phase during which the OLED is capable of emitting light. The EMI(n) signal is changed from the low voltage value to the high voltage value, causing transistor T5 to be turned on. As transistor T5 is turned on, the drain of the n-type first drive transistor $T_{DN}$ is connected to the cathode of the OLED. Similarly as in previous embodiments, the same current flows through the n-type first drive transistor $T_{DN}$, the p-type second drive transistor $T_{DP}$, and the OLED. The current that flows through the n-type first drive transistor is:

$$I_{dn}=\frac{\beta_{TDN}}{2}(V_G-V_x-V_{TH_n})^2$$

The current that flows through the p-type second drive transistor is:

$$I_{dp}=\frac{\beta_{TDP}}{2}(V_x-V_{DAT}-|V_{TH_{Tp}}|)^2$$

Similarly as in previous embodiments, as $I_{dn}=I_{dp}=I_{OLED}$ and $V_G=V_{REF}+V_{THn}+|V_{THp}|$, the current flow through the OLED will be:

$$I_{OLED} = \frac{\beta_{TDN}\beta_{TDP}(V_{REF} - V_{DAT})^2}{2(\sqrt{\beta_{TDN}} + \sqrt{\beta_{TDP}})^2}$$

Accordingly, the current to the OLED does not depend on the threshold voltage of the p-type second drive transistor $T_{DP}$ and the threshold voltage of the n-type first drive transistor $T_{DN}$, and hence the current to the OLED device $I_{OLED}$ s not affected by the threshold voltage variations of the drive transistors. In this manner, variation in the threshold voltages of the drive transistors has been compensated. Similarly as in previous embodiments, the OLED current also is not affected by the variations of the supplies ELVDD and ELVSS, such as any IR drop on the supply lines. In addition, the threshold compensation and data programming operations are independent of each other, and a short one horizontal time can be achieved with a short data programming phase. The short one horizontal time improves the responsiveness of the OLED.

Figure 19B:
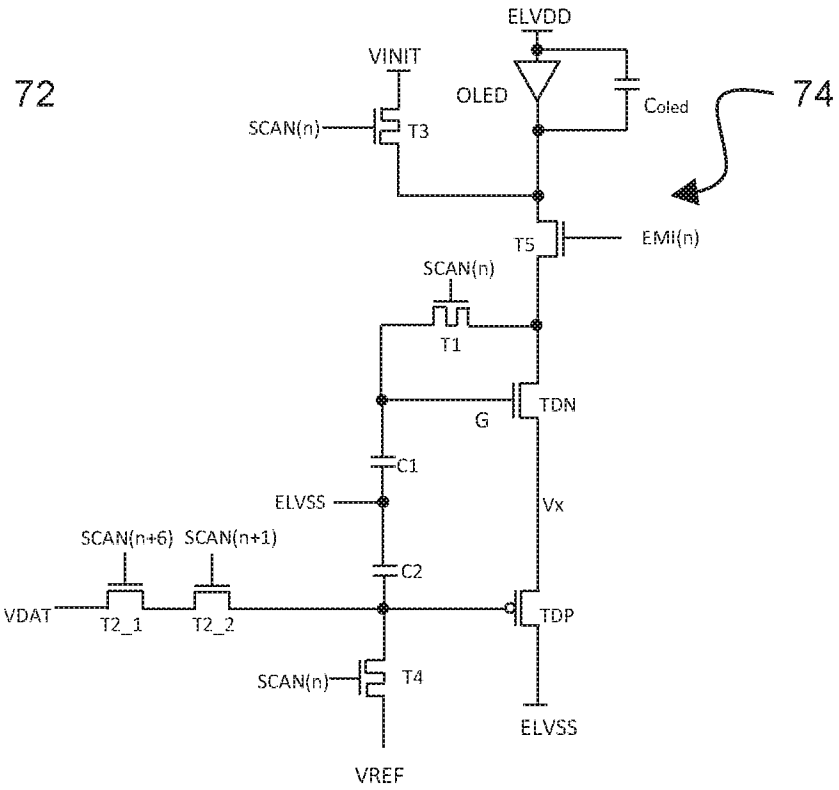
FIG. 19A and FIG. 19B are drawings depicting two circuit variations of the seventh circuit configuration of FIG. 17.
Figure 19A:
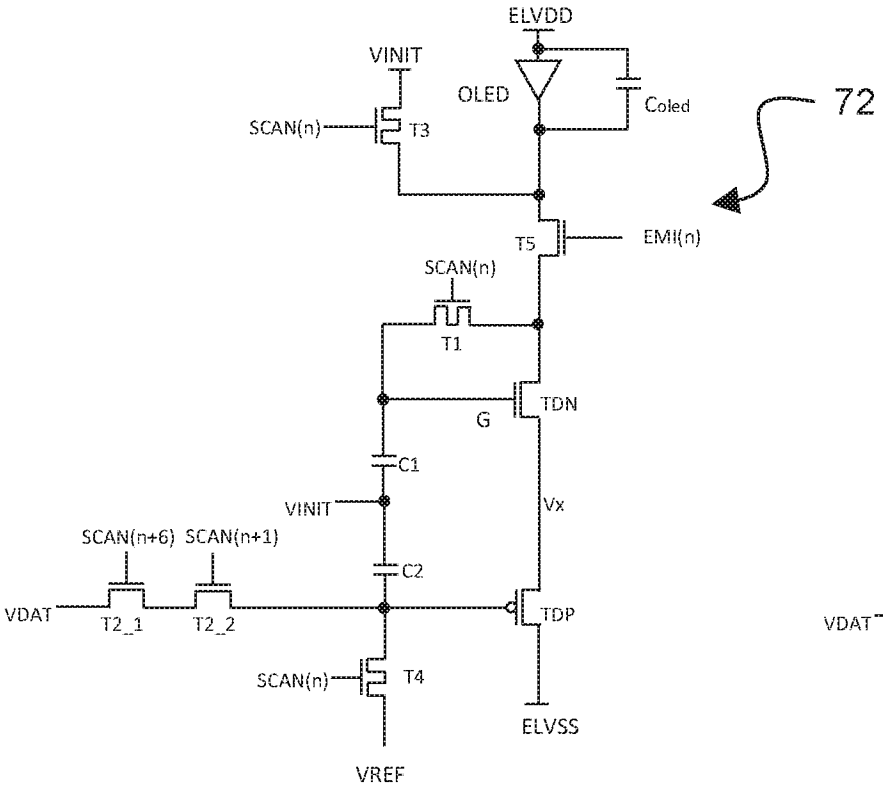

FIG. 19A and FIG. 19B are respective drawings depicting two circuit configurations 72 and 74 that are variations on the circuit configuration 70 of FIG. 17. The timing diagram of FIG. 18 is equally applicable for the circuit configurations 72 and 74. The difference between circuit configuration 70 and circuit configurations 72 and 74 (similarly as in previous embodiments) is the power supply that is connected to the node where the bottom plate of the first storage capacitor C1 and the top plate of the second storage capacitor C2 are connected. In the circuit configuration 70, such node is connected to the reference power supply line VREF. In the circuit configuration 72 such node is connected to the initialization power supply line VINIT, and in the circuit configuration 74 such node is connected to the power supply ELVSS. In general, the node can be connected to any power supply with a fixed voltage level, which is available for the pixel, to set the voltage at the node between the capacitors relative to the gates of the drive transistors.

Figure 20:
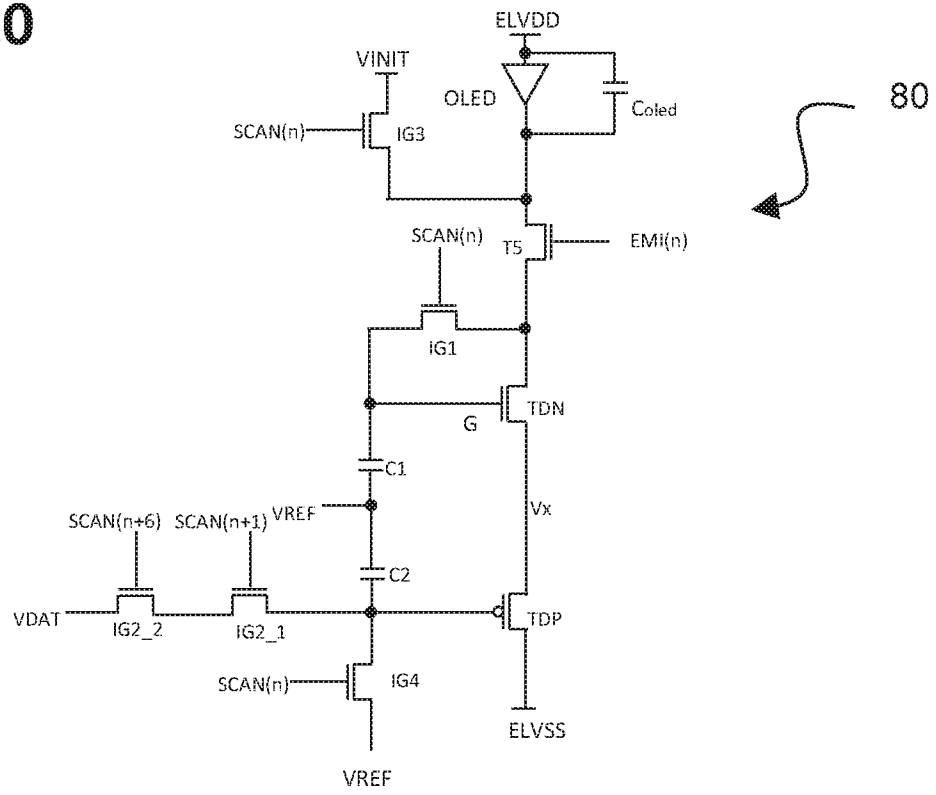
FIG. 20 is a drawing depicting an eighth circuit configuration in accordance with embodiments of the present application.

FIG. 20 is a drawing depicting an eighth circuit configuration 80 in accordance with embodiments of the present application, which is comparable to the circuit configuration 70 of FIG. 17, and thus FIG. 18 also is applicable as a timing diagram associated with the operation of the circuit configuration 80 of FIG. 20. In this example, the circuit 80 uses ultra-low leakage oxide transistors, such as indium gallium zinc oxide (IGZO) devices, as the data switch device and switches associated with the storage capacitors. This permits the stored data voltage and drive transistor threshold voltages to be retained longer on the capacitors due to the ultra-low off leakage property of the ultra-low leakage transistors. As a result, the refresh rate can be reduced as compared to conventional configurations, down to about 30 Hz or lower, which is particularly suitable for displaying static images.

Similarly as circuit configuration 70, FIG. 20 depicts the TFT circuit 80 configured with multiple n-type TFTs and one p-type TFT. $T_{DN}$ is an n-type first drive transistor that is an analogue TFT, IG1, IG2_1, IG2_2, IG3, IG4 and T5 are n-type digital switch TFTs, and $T_{DP}$ is a p-type second drive transistor that is an analogue TFT. As referenced above, C1 and C2 are capacitors and they are both storage capacitors. $C_{oled}$ is the internal capacitance of the OLED device (i.e., Cole is not a separate component, but is inherent to the OLED). The OLED further is connected to a power supply ELVDD as is conventional. In addition, although the embodiments are described principally in connection with an OLED as the light-emitting device, comparable principles may be used with display technologies that employ other types of light-emitting devices, including for example micro LEDs and quantum dot LEDs. The principal difference between the circuit configuration 80 and the circuit configuration 70 is that the dual gate switch TFTs T1, T2_1, T2_2, T3 and T4 in the circuit configuration 70 are replaced by ultra-low leakage IGZO TFTs IG1, IG2_1, IG2_2, IG3, and IG4 in the circuit configuration 80. The timing and operations of the circuit configuration 80 are essentially the same as the timing and operations of circuit configuration 70. In addition, the n-type transistor T5 and the first drive transistor $T_{DN}$ can also be IGZO devices. The production cost may be reduced if all the n-type transistors are manufactured as the same type.

An aspect of the invention, therefore, is a pixel circuit for a display device operable in an initialization phase, a compensation phase, a data programming phase, and an emission phase, whereby the one horizontal time is minimized while maintaining accurate compensation of the threshold voltages of the drive transistors, and further accounting for any variations in the voltage supplies. In exemplary embodiments, the pixel circuit includes a first drive transistor configured to control an amount of current to a light-emitting device during an emission phase depending upon voltages applied to a gate and a first terminal of the first drive transistor; a second drive transistor that is configured as a source follower, wherein a first terminal of the second drive transistor is connected to a first power supply line and a second terminal of the second drive transistor is connected to the first terminal of the first drive transistor; wherein the first drive transistor is one of a p-type or n-type transistor and the second drive transistor is the other of a p-type or n-type transistor; and a light-emitting device that is electrically connected at a first terminal to a second terminal of the first drive transistor during the emission phase and at a second terminal to a second power supply line. The pixel circuit may include one or more of the following features, either individually or in combination.

In an exemplary embodiment of the pixel circuit, a voltage at the second terminal of the second drive transistor follows a voltage applied to the gate of the second drive transistor;

In an exemplary embodiment of the pixel circuit, the pixel circuit further includes a first capacitor and a second capacitor, wherein the first capacitor is connected at a first plate to the gate of the first drive transistor and at a second plate to a first plate of the second capacitor, and the second capacitor is connected at a second plate to the gate of the second drive transistor.

In an exemplary embodiment of the pixel circuit, the pixel circuit further includes a first switch transistor connected to the gate of the first drive transistor and to the second terminal of the first drive transistor, such that when the first switch transistor is in an on state the first drive transistor becomes diode-connected such that the gate and the second terminal of the drive transistor are electrically connected through the first transistor.

In an exemplary embodiment of the pixel circuit, the pixel circuit further includes a second switch transistor connected to the gate of the second drive transistor and a data voltage line, such that when the second transistor is in an on state during a data programming phase, the data voltage is applied to the gate of the second drive transistor and to the second plate of the second capacitor.

In an exemplary embodiment of the pixel circuit, the pixel circuit further includes a second switch transistor and a sixth switch transistor, wherein the gate of the second drive transistor and a data voltage line are connected through the second switch transistor and the sixth switch transistor, such that when the second switch transistor and the sixth switch transistor are in an on state during a data programming phase, the data voltage is applied to the gate of the second drive transistor and to the second plate of the second capacitor.

In an exemplary embodiment of the pixel circuit, the pixel circuit further includes a third switch transistor connected to the gate of the second drive transistor and a reference voltage line, such that when the third switch transistor is in an on state during an initialization phase and during a threshold compensation phase, the reference voltage is applied to the gate of the second drive transistor.

In an exemplary embodiment of the pixel circuit, the pixel circuit further includes a fourth switch transistor connected to the first terminal of the light-emitting device and an initialization voltage line, such that when the fourth switch transistor is in an on state during an initialization phase and during a threshold compensation phase, the initialization voltage is applied to the first terminal of the light-emitting device.

In an exemplary embodiment of the pixel circuit, the pixel circuit further includes a fifth switch transistor connected to the second terminal of the first drive transistor and the first terminal of the light-emitting device, such that when the fifth switch transistor is in an on state during the initialization phase the initialization voltage is applied to the gate of the first drive transistor through the fourth, fifth, and first switch transistors; and when the fifth transistor is in an on state during the emission phase, current flows from the first power supply to the light-emitting device through the first and second drive transistors and the fifth switch transistor.

In an exemplary embodiment of the pixel circuit, a node comprising a connection of the second plate of the first capacitor and the first plate of the second capacitor is connected to any one of the first power supply line, a reference voltage line, or an initialization voltage line; and wherein the first capacitor stores threshold voltages of the first drive transistor and the second drive transistor to compensate the threshold voltages for light emission, and the second capacitor stores the data voltage for light emission.

In an exemplary embodiment of the pixel circuit, at least one of the first switch transistor, the second switch transistor, the third switch transistor, the fourth switch transistor, the sixth switch transistor and one of the drive transistors is an ultra-low leakage indium gallium zinc oxide (IGZO) transistor In an exemplary embodiment of the pixel circuit, the light-emitting device is one of an organic light-emitting diode, a micro light-emitting diode (LED), or a quantum dot LED.

Another aspect of the invention is a method of operating a pixel circuit according to any of the embodiments, whereby the one horizontal time is minimized while maintaining accurate compensation of the threshold voltages of the drive transistors, and further accounting for any variations in the voltage supplies. In exemplary embodiments, the method of operating includes the steps of providing a pixel circuit according to any of the embodiments; performing a compensation phase to compensate threshold voltages of the first and second drive transistors comprising: diode connecting the first drive transistor by placing the first switch transistor in an on state to electrically connect the gate and the second terminal of the first drive transistor through the first switch transistor; applying a reference voltage from the reference voltage line to the gate of the second drive transistor through the third switch transistor; and electrically disconnecting the first terminal of the light emitting device from the second terminal of the first drive transistor; wherein the threshold voltages of the first and second drive transistors are stored on the first plate of the first capacitor; performing a data programming phase to program a data voltage from the data voltage line to the second capacitor, comprising applying the data voltage through the second switch transistor to the second plate of the second capacitor and to the gate of the second drive transistor; and performing an emission phase during which light is emitted from the light-emitting device comprising: applying the first power supply to the first terminal of the second drive transistor; and electrically connecting the second terminal of the first drive transistor to the first plate of the light-emitting device thereby applying the second power supply to the second terminal of the light-emitting device. The method may include one or more of the following features, either individually or in combination.

In an exemplary embodiment of the method of operating, the pixel circuit further comprises a fourth switch transistor that is connected between an initialization voltage line and the first terminal of the light-emitting device; and the method further comprises operating in an initialization phase to initialize the gate voltage of the first drive transistor, the voltage across the light-emitting device, and the voltage across the first storage capacitor and the second storage capacitor, wherein during the initialization phase and the threshold compensation phase an initialization voltage is applied from the initialization voltage line to the first plate of the light-emitting device through the fourth switch transistor.

In an exemplary embodiment of the method of operating, the pixel circuit further comprises a fifth switch transistor connected to the second terminal of the first drive transistor and the first terminal of the light-emitting device; the initialization phase further includes placing the first switch transistor and the fifth transistor in an on state to apply the initialization voltage to the gate of the first drive transistor through the fourth, fifth, and first switch transistors; the compensation phase further includes electrically disconnecting the first terminal of the light-emitting device from the second terminal of the first drive transistor by turning off the fifth switch transistor; and the emission phase further includes electrically connecting the first terminal of the light-emitting device to the second terminal of the first drive transistor by turning on the fifth switch transistor.

In an exemplary embodiment of the method of operating, the initialization phase further comprises: applying the reference voltage from the reference voltage line to a node comprising a connection of the second plate of the first capacitor and the first plate of the second capacitor; and applying the reference voltage from the reference voltage line to the gate of the second drive transistor by connecting the gate of the second drive transistor to the reference voltage line through the third switch transistor.

In an exemplary embodiment of the method of operating, the initialization voltage is set to a voltage whereby a difference between the initialization voltage and a voltage of the second power supply is less than a threshold voltage of the light-emitting device, such that there is no light emission from the light-emitting device when the initialization voltage is applied to the first plate of the light-emitting device.

In an exemplary embodiment of the method of operating, the reference voltage and the initialization voltage are set such that a difference between the reference voltage and the initialization voltage is larger than a sum of the threshold voltages of the first drive transistor and the second drive transistor.

In an exemplary embodiment of the method of operating, during the data programming phase, a dedicated SCAN signal is applied to a gate of the second switch transistor to apply the data voltage.

In an exemplary embodiment of the method of operating, the pixel circuit further comprises a second switch transistor and a sixth switch transistor, and wherein the gate of the second drive transistor and a data voltage line are connected through the second switch transistor and the sixth switch transistor, such that when the second switch transistor and the sixth switch transistor are in an on state during a data programming phase, the data voltage is applied to the gate of the second drive transistor and to the second plate of the second capacitor; and wherein during the data programming phase, a SCAN signal from another pixel row is applied to a gate of the second switch transistor to apply the data voltage.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

INDUSTRIAL APPLICABILITY

Embodiments of the present application are applicable to many display devices to permit display devices of high resolution with effective threshold voltage compensation and true black performance. Examples of such devices include televisions, mobile phones, personal digital assistants (PDAs), tablet and laptop computers, desktop monitors, digital cameras, and like devices for which a high resolution display is desirable.

REFERENCE SIGNS LIST

10—first circuit configuration
12, 14—first circuit configuration variants
20—second circuit configuration
22, 24—second circuit configuration variants
30—third circuit configuration
32, 34—third circuit configuration variants
40—fourth circuit configuration
42, 44—fourth circuit configuration variants
50—fifth circuit configuration
52, 54—fifth circuit configuration variants
60—sixth circuit configuration
70—seventh circuit configuration
72, 74—seventh circuit configuration variants
80—eighth circuit configuration
T1-T5 (T2_1, T2_2)—multiple TFT transistors
IG1-IG4 (IG2_1, IG2_2)—multiple IGZO transistors
OLED—organic light emitting diode (or generally light-emitting device)
C1, C2—storage capacitors
$C_{oled}$—internal capacitance of OLED
G—Node in the pixel circuits
Vx—Node in the pixel circuits
VDAT—data voltage
ELVSS—power supply
ELVDD—power supply
VREF—reference voltage supply
VINIT—initialization voltage supply
SCAN/SCAND/EMI—control signals

The invention claimed is:

1. A pixel circuit for a display device comprising:

a first drive transistor configured to control an amount of current to a light-emitting device during an emission phase depending upon voltages applied to a gate and a first terminal of the first drive transistor;

a second drive transistor that is configured as a source follower, wherein a first terminal of the second drive transistor is connected to a first power supply line and a second terminal of the second drive transistor is connected to the first terminal of the first drive transistor;

wherein the first drive transistor is one of a p-type or n-type transistor and the second drive transistor is the other of a p-type or n-type transistor;

the light-emitting device being electrically connected at a first terminal to a second terminal of the first drive transistor during the emission phase and at a second terminal to a second power supply line;

a first capacitor and a second capacitor, wherein the first capacitor is connected at a first plate to the gate of the first drive transistor and at a second plate to a first plate of the second capacitor, and the second capacitor is connected at a second plate to the pate of the second drive transistor;

a first switch transistor connected to the gate of the first drive transistor and to the second terminal of the first drive transistor, such that when the first switch transistor is in an on state the first drive transistor becomes diode-connected such that the gate and the second terminal of the drive transistor are electrically connected through the first transistor; and a second switch transistor connected to the gate of the second drive transistor and a data voltage line, such that when the second transistor is in an on state during a data programming phase, the data voltage is applied to the gate of the second drive transistor and to the second plate of the second capacitor.

2. The pixel circuit of claim 1, wherein a voltage at the second terminal of the second drive transistor follows a voltage applied to the gate of the second drive transistor.

3. A pixel circuit for a display device comprising:

a first drive transistor configured to control an amount of current to a light-emitting device during an emission phase depending upon voltages applied to a gate and a first terminal of the first drive transistor;

a second drive transistor that is configured as a source follower, wherein a first terminal of the second drive transistor is connected to a first power supply line and a second terminal of the second drive transistor is connected to the first terminal of the first drive transistor;

wherein the first drive transistor is one of a p-type or n-type transistor and the second drive transistor is the other of a p-type or n-type transistor;

the light-emitting device being electrically connected at a first terminal to a second terminal of the first drive transistor during the emission phase and at a second terminal to a second power supply line;

a first capacitor and a second capacitor, wherein the first capacitor is connected at a first plate to the gate of the first drive transistor and at a second plate to a first plate of the second capacitor, and the second capacitor is connected at a second plate to the gate of the second drive transistor;

a first switch transistor connected to the gate of the first drive transistor and to the second terminal of the first drive transistor, such that when the first switch transistor is in an on state the first drive transistor becomes diode-connected such that the gate and the second terminal of the drive transistor are electrically connected through the first transistor; and a second switch transistor and a sixth switch transistor, wherein the gate of the second drive transistor and a data voltage line are connected through the second switch transistor and the sixth switch transistor, such that when the second switch transistor and the sixth switch transistor are in an on state during a data programming phase, the data voltage is applied to the gate of the second drive transistor and to the second plate of the second capacitor.

4. The pixel circuit of claim 1, further comprising a third switch transistor connected to the gate of the second drive transistor and a reference voltage line, such that when the third switch transistor is in an on state during an initialization phase and during a threshold compensation phase, the reference voltage is applied to the gate of the second drive transistor.

5. The pixel circuit of claim 1, further comprising a fourth switch transistor connected to the first terminal of the light-emitting device and an initialization voltage line, such that when the fourth switch transistor is in an on state during an initialization phase and during a threshold compensation phase, the initialization voltage is applied to the first terminal of the light-emitting device.

6. The pixel circuit of claim 5, further comprising a fifth switch transistor connected to the second terminal of the first drive transistor and the first terminal of the light-emitting device, such that when the fifth switch transistor is in an on state during the initialization phase the initialization voltage is applied to the gate of the first drive transistor through the fourth, fifth, and first switch transistors; and when the fifth transistor is in an on state during the emission phase, current flows from the first power supply to the light-emitting device through the first and second drive transistors and the fifth switch transistor.

7. The pixel circuit of claim 2, wherein a node comprising a connection of the second plate of the first capacitor and the first plate of the second capacitor is connected to any one of the first power supply line, a reference voltage line, or an initialization voltage line; and wherein the first capacitor stores threshold voltages of the first drive transistor and the second drive transistor to compensate the threshold voltages for light emission, and the second capacitor stores the data voltage for light emission.

8. The pixel circuit of claim 5, wherein at least one of the first switch transistor, the second switch transistor, the third switch transistor, the fourth switch transistor, and the sixth switch transistor and one of the drive transistors is an ultra-low leakage indium gallium zinc oxide (IGZO) transistor.

9. The pixel circuit of claim 1, wherein the light-emitting device is one of an organic light-emitting diode, a micro light-emitting diode (LED), or a quantum dot LED.

10. A method of operating a pixel circuit for a display device comprising the steps of:

providing a pixel circuit comprising:

a first drive transistor configured to control an amount of current to a light-emitting device during an emission phase depending upon voltages applied to a gate and a first terminal of the first drive transistor;

a second drive transistor that is configured as a source follower, wherein a first terminal of the second drive transistor is connected to a first power supply line and a second terminal of the second drive transistor is connected to a first terminal of the first drive transistor, and a voltage at the second terminal of the second drive transistor follows a voltage applied to a gate of the second drive transistor;

wherein the first drive transistor is one of a p-type or n-type transistor and the second drive transistor is the other of a p-type or n-type transistor;

the light-emitting device being electrically connected at a first terminal to a second terminal of the first drive transistor during the emission phase, and at a second terminal to a second power supply line;

a first capacitor and a second capacitor, wherein the first capacitor is connected at a first plate to the gate of the first drive transistor and at a second plate to a first plate of the second capacitor, and the second capacitor is connected at a second plate to the gate of the second drive transistor;

a first switch transistor connected to the gate of the first drive transistor and to the second terminal of the first drive transistor;

a second switch transistor connected to the gate of the second drive transistor and a data voltage line; and a third switch transistor connected to the gate of the second drive transistor and a reference voltage line;

performing a compensation phase to compensate threshold voltages of the first and second drive transistors comprising: diode connecting the first drive transistor by placing the first switch transistor in an on state to electrically connect the gate and the second terminal of the first drive transistor through the first switch transistor; applying a reference voltage from the reference voltage line to the gate of the second drive transistor through the third switch transistor; and electrically disconnecting the first terminal of the light emitting device from the second terminal of the first drive transistor; wherein the threshold voltages of the first and second drive transistors are stored on the first plate of the first capacitor;

performing a data programming phase to program a data voltage from the data voltage line to the second capacitor, comprising applying the data voltage through the second switch transistor to the second plate of the second capacitor and to the gate of the second drive transistor; and performing an emission phase during which light is emitted from the light-emitting device comprising: applying the first power supply to the first terminal of the second drive transistor; and electrically connecting the second terminal of the first drive transistor to the first plate of the light-emitting device thereby applying the second power supply to the second terminal of the light-emitting device.

11. The method of operating of claim 10, wherein the pixel circuit further comprises a fourth switch transistor that is connected between an initialization voltage line and the first terminal of the light-emitting device; and the method further comprises operating in an initialization phase to initialize the gate voltage of the first drive transistor, the voltage across the light-emitting device, and the voltage across the first storage capacitor and the second storage capacitor, wherein during the initialization phase and the threshold compensation phase an initialization voltage is applied from the initialization voltage line to the first plate of the light-emitting device through the fourth switch transistor.

12. The method of operating of claim 11, wherein:

the pixel circuit further comprises a fifth switch transistor connected to the second terminal of the first drive transistor and the first terminal of the light-emitting device;

the initialization phase further includes placing the first switch transistor and the fifth transistor in an on state to apply the initialization voltage to the gate of the first drive transistor through the fourth, fifth, and first switch transistors;

the compensation phase further includes electrically disconnecting the first terminal of the light-emitting device from the second terminal of the first drive transistor by turning off the fifth switch transistor; and the emission phase further includes electrically connecting the first terminal of the light-emitting device to the second terminal of the first drive transistor by turning on the fifth switch transistor.

13. The method of operating of claim 11, wherein the initialization phase further comprises:

applying the reference voltage from the reference voltage line to a node comprising a connection of the second plate of the first capacitor and the first plate of the second capacitor; and applying the reference voltage from the reference voltage line to the gate of the second drive transistor by connecting the gate of the second drive transistor to the reference voltage line through the third switch transistor.

14. The method of operating of claim 11, wherein the initialization voltage is set to a voltage whereby a difference between the initialization voltage and a voltage of the second power supply is less than a threshold voltage of the light-emitting device, such that there is no light emission from the light-emitting device when the initialization voltage is applied to the first plate of the light-emitting device.

15. The method of operating of claim 11, wherein the reference voltage and the initialization voltage are set such that a difference between the reference voltage and the initialization voltage is larger than a sum of the threshold voltages of the first drive transistor and the second drive transistor.

16. The method of operating of claim 10, wherein during the data programming phase, a dedicated SCAN signal is applied to a gate of the second switch transistor to apply the data voltage.

17. The method of operating of claim 10, wherein the pixel circuit further comprises a second switch transistor and a sixth switch transistor, and wherein the gate of the second drive transistor and a data voltage line are connected through the second switch transistor and the sixth switch transistor, such that when the second switch transistor and the sixth switch transistor are in an on state during a data programming phase, the data voltage is applied to the gate of the second drive transistor and to the second plate of the second capacitor; and wherein during the data programming phase, a SCAN signal from another pixel row is applied to a gate of the second switch transistor to apply the data voltage.

* * * * *